US011519057B2

(12) United States Patent
Siles et al.

(10) Patent No.: US 11,519,057 B2
(45) Date of Patent: Dec. 6, 2022

(54) ALUMINUM ALLOY FOR IMPACT EXTRUDED CONTAINERS AND METHOD OF MAKING THE SAME

(71) Applicant: BALL CORPORATION, Broomfiedl, CO (US)

(72) Inventors: John L. Siles, Westminster, CO (US); Samuel Melancon, Quebec (CA); Stanley Platek, Edgewater, MD (US); Anthony Chatey, Kolin (CZ)

(73) Assignee: BALL CORPORATION, Westminster, CO (US)

( * ) Notice: Subject to any disclaimer, the term of this patent is extended or adjusted under 35 U.S.C. 154(b) by 0 days.

(21) Appl. No.: 16/474,953

(22) PCT Filed: Dec. 30, 2016

(86) PCT No.: PCT/US2016/069454

§ 371 (c)(1),
(2) Date: Jun. 28, 2019

(87) PCT Pub. No.: WO2018/125199

PCT Pub. Date: Jul. 5, 2018

(65) Prior Publication Data

US 2019/0345586 A1 Nov. 14, 2019

(51) Int. Cl.
*B21C 23/18* (2006.01)
*B65D 1/02* (2006.01)
(Continued)

(52) U.S. Cl.
CPC ..... *C22C 21/00* (2013.01); *B21C 23/18* (2013.01); *B65D 1/0207* (2013.01); *C22F 1/04* (2013.01)

(58) Field of Classification Search
CPC ..... C22C 21/00; C22C 21/08; B21C 23/18; B65D 1/0207; C22F 1/04; C22F 1/05
See application file for complete search history.

(56) References Cited

U.S. PATENT DOCUMENTS 3,029,507 A 4/1962 Gaggini
3,232,260 A 2/1966 Siemonsen
(Continued)

FOREIGN PATENT DOCUMENTS

CA 1252649 4/1989
CA 2133312 7/1994
(Continued)

OTHER PUBLICATIONS

International Search Report prepared by the European Patent Office dated Jul. 18, 2017, for International Application No. PCT/US2016/069454.

(Continued)

*Primary Examiner* — Daniel J. Schleis
*Assistant Examiner* — Kevin Ct Li
(74) *Attorney, Agent, or Firm* — Sheridan Ross P.C.

(57) ABSTRACT

Novel aluminum alloys are provided for use in an impact extrusion manufacturing process to create shaped containers and other articles of manufacture. In one embodiment blends of recycled scrap aluminum are used in conjunction with relatively pure aluminum to create novel compositions which may be formed and shaped in an environmentally friendly process. Other embodiments include methods for manufacturing a slug material comprising mixtures of aluminum alloys for use in the impact extraction process, a container manufactured using the aluminum alloy in an impact extrusion process, and the container, wherein the material of the container is the aluminum alloy.

19 Claims, 10 Drawing Sheets

(51) Int. Cl.
*C22C 21/00* (2006.01)
*C22F 1/04* (2006.01)

(56) References Cited

U.S. PATENT DOCUMENTS

| | | | |
|---|---|---|---|
| 3,812,646 | A | 5/1974 | Baldyga et al. |
| 4,243,438 | A | 1/1981 | Yanagida et al. |
| 4,260,419 | A | 4/1981 | Robertson |
| 4,269,632 | A | 5/1981 | Robertson et al. |
| 4,282,044 | A | 8/1981 | Robertson et al. |
| 4,318,755 | A | 3/1982 | Jeffrey et al. |
| 4,403,493 | A | 9/1983 | Atkinson |
| 4,411,707 | A | 10/1983 | Brennecke et al. |
| 4,693,108 | A | 9/1987 | Traczyk et al. |
| 4,732,027 | A | 3/1988 | Traczyk et al. |
| 5,102,705 | A | 4/1992 | Yammoto et al. |
| 5,104,465 | A | 4/1992 | McAuliffe et al. |
| 5,110,545 | A | 5/1992 | McAuliffe et al. |
| 5,138,858 | A | 8/1992 | Johnson et al. |
| 5,293,765 | A | 3/1994 | Nussbaum-Pogacnik |
| 5,355,710 | A | 10/1994 | Diekhoff |
| 5,362,341 | A | 11/1994 | Palmer et al. |
| 5,394,727 | A | 3/1995 | Diekhoff et al. |
| 5,448,903 | A | 9/1995 | Johnson |
| 5,469,729 | A | 11/1995 | Hager |
| 5,486,243 | A | 1/1996 | Hashiguchi et al. |
| 5,487,295 | A | 1/1996 | Diekhoff et al. |
| 5,503,690 | A | 4/1996 | Wade et al. |
| 5,522,248 | A | 6/1996 | Diekhoff et al. |
| 5,522,950 | A | 6/1996 | Bartges et al. |
| 5,551,997 | A | 9/1996 | Marder et al. |
| 5,571,347 | A | 11/1996 | Bergsma |
| 5,572,893 | A | 11/1996 | Goda et al. |
| 5,704,240 | A | 1/1998 | Jordan |
| 5,713,235 | A | 2/1998 | Diekhoff |
| 5,718,352 | A | 2/1998 | Diekhoff et al. |
| 5,769,331 | A | 6/1998 | Yamagishi et al. |
| 5,772,802 | A | 6/1998 | Sun et al. |
| 5,778,723 | A | 7/1998 | Diekhoff |
| 5,822,843 | A | 10/1998 | Diekhoff et al. |
| 6,010,026 | A | 1/2000 | Diekhoff et al. |
| 6,010,028 | A | 1/2000 | Jordan et al. |
| 6,100,028 | A | 8/2000 | Cole et al. |
| 6,126,034 | A | 10/2000 | Borden et al. |
| 6,171,362 | B1 | 1/2001 | Osumi et al. |
| 6,355,090 | B1 | 3/2002 | Ohyama et al. |
| 6,368,427 | B1 | 4/2002 | Sigworth |
| 6,543,636 | B1 | 4/2003 | Flecheux et al. |
| 6,607,615 | B1 | 8/2003 | Bekki et al. |
| 6,627,012 | B1 | 9/2003 | Tack et al. |
| 6,630,037 | B1 | 10/2003 | Sawada et al. |
| 6,666,933 | B2 | 12/2003 | Roberts et al. |
| 6,676,775 | B2 | 1/2004 | Barth et al. |
| 6,945,085 | B1 | 9/2005 | Goda |
| 6,959,830 | B1 | 11/2005 | Kanou et al. |
| 7,117,704 | B2 | 10/2006 | Ogura et al. |
| 7,140,223 | B2 | 11/2006 | Chupak |
| 7,147,123 | B2 | 12/2006 | Yamashita |
| 7,171,840 | B2 | 2/2007 | Kanou et al. |
| 7,294,213 | B2 | 11/2007 | Warner et al. |
| 7,520,044 | B2 | 4/2009 | Bulliard et al. |
| 7,555,927 | B2 | 7/2009 | Hanafusa et al. |
| 7,588,808 | B2 | 9/2009 | Hutchinson et al. |
| 7,666,267 | B2 | 2/2010 | Benedictus et al. |
| 7,713,363 | B2 | 5/2010 | Sano et al. |
| 7,798,357 | B2 | 9/2010 | Hanafusa et al. |
| 7,824,750 | B2 | 11/2010 | Takegoshi et al. |
| 8,037,728 | B2 | 10/2011 | Hosoi |
| 8,037,734 | B2 | 10/2011 | Hanafusa et al. |
| 8,091,402 | B2 | 1/2012 | Hanafusa et al. |
| 8,132,439 | B2 | 3/2012 | Hanafusa et al. |
| 8,132,687 | B2 | 3/2012 | Fedusa et al. |
| 8,313,003 | B2 | 11/2012 | Riley et al. |
| 8,349,419 | B2 | 1/2013 | Nishida et al. |
| 9,227,748 | B2 | 1/2016 | Nakagawa et al. |
| 9,327,899 | B2 | 5/2016 | Greenfield et al. |
| 9,517,498 | B2 | 12/2016 | Siles et al. |
| 9,663,846 | B2 | 5/2017 | Siles et al. |
| 2001/0003292 | A1 | 6/2001 | Sun et al. |
| 2001/0031376 | A1 | 10/2001 | Fulton et al. |
| 2002/0000788 | A1 | 1/2002 | Ostergaard et al. |
| 2002/0007881 | A1* | 1/2002 | Daaland ..... C22C 21/10 148/439 |
| 2004/0025981 | A1 | 2/2004 | Tack et al. |
| 2004/0035871 | A1 | 2/2004 | Chupak |
| 2004/0140237 | A1 | 7/2004 | Brownewell |
| 2004/0173560 | A1 | 9/2004 | Chupak |
| 2004/0213695 | A1 | 10/2004 | Ferreira et al. |
| 2005/0067365 | A1 | 3/2005 | Hanafusa et al. |
| 2005/0127077 | A1 | 6/2005 | Chupak |
| 2006/0021415 | A1 | 2/2006 | Bulliard et al. |
| 2007/0062952 | A1 | 3/2007 | Kobayashi et al. |
| 2007/0295051 | A1 | 12/2007 | Myers et al. |
| 2008/0011702 | A1 | 1/2008 | Walsh |
| 2008/0022746 | A1 | 1/2008 | Myers et al. |
| 2008/0041501 | A1* | 2/2008 | Platek ..... C22C 21/06 148/551 |
| 2008/0163663 | A1 | 7/2008 | Hankey et al. |
| 2008/0181812 | A1 | 7/2008 | Ferreira et al. |
| 2008/0299001 | A1 | 12/2008 | Langlais et al. |
| 2009/0220714 | A1 | 9/2009 | Nishida et al. |
| 2009/0277862 | A1 | 11/2009 | Masuda et al. |
| 2010/0065528 | A1 | 3/2010 | Hanafusa et al. |
| 2010/0199741 | A1 | 8/2010 | Myers et al. |
| 2010/0326946 | A1 | 12/2010 | Hanafusa et al. |
| 2011/0113732 | A1 | 5/2011 | Adams et al. |
| 2012/0024813 | A1 | 2/2012 | Nakagawa et al. |
| 2012/0031913 | A1 | 2/2012 | Moore et al. |
| 2012/0269602 | A1 | 10/2012 | Hanafusa et al. |
| 2013/0068352 | A1* | 3/2013 | Siles ..... C22F 1/04 148/552 |
| 2013/0202477 | A1 | 8/2013 | Zajac et al. |
| 2014/0298641 | A1 | 10/2014 | Siles et al. |

FOREIGN PATENT DOCUMENTS

| | | |
|---|---|---|
| CA | 2169743 | 2/1995 |
| CA | 2206483 | 9/1999 |
| CA | 2302557 | 9/2001 |
| CA | 2655925 | 1/2008 |
| CA | 2662199 | 3/2008 |
| CA | 2638403 | 10/2009 |
| CN | 1044925 | 8/1990 |
| CN | 1256671 | 6/2000 |
| CN | 1617821 | 5/2005 |
| CN | 1994826 | 7/2007 |
| CN | 101294255 | 10/2008 |
| CN | 100515875 | 7/2009 |
| CN | 101888907 | 11/2010 |
| CN | 101985707 | 3/2011 |
| DE | 60206036 | 6/2006 |
| EP | 0721384 | 7/1996 |
| EP | 1136154 | 9/2001 |
| EP | 1531952 | 8/2006 |
| EP | 1731239 | 12/2006 |
| EP | 2119515 | 11/2009 |
| EP | 2146907 | 1/2010 |
| EP | 2531409 | 12/2012 |
| EP | 2646328 | 10/2013 |
| EP | 2955131 | 12/2015 |
| FR | 2457328 | 12/1980 |
| GB | 971258 | 9/1964 |
| GB | 1215648 | 12/1970 |
| GB | 1598428 | 9/1981 |
| JP | S61-163233 | 7/1986 |
| JP | S62-263954 | 11/1987 |
| JP | H04-99142 | 3/1992 |
| JP | H06-279888 | 10/1994 |
| JP | H10-203573 | 8/1998 |
| JP | H11-293363 | 10/1999 |
| JP | 2000-063973 | 2/2000 |
| JP | 2001-115226 | 4/2001 |
| JP | 2001-172728 | 6/2001 |
| JP | 2001-181768 | 7/2001 |

(56) References Cited

FOREIGN PATENT DOCUMENTS

| | | |
|---|---|---|
| JP | 2001-213416 | 8/2001 |
| JP | 2001-315745 | 11/2001 |
| JP | 2002-173717 | 6/2002 |
| JP | 3408213 | 5/2003 |
| JP | 2003-205924 | 7/2003 |
| JP | 2003-268460 | 9/2003 |
| JP | 2003-334631 | 11/2003 |
| JP | 2004-035036 | 2/2004 |
| JP | 2004-083128 | 3/2004 |
| JP | 2005-096843 | 4/2005 |
| JP | 2005-511418 | 4/2005 |
| JP | 2005-193272 | 7/2005 |
| JP | 2005-280768 | 10/2005 |
| JP | 2006-62755 | 3/2006 |
| JP | 2006-62756 | 3/2006 |
| JP | 3754076 | 3/2006 |
| JP | 3886329 | 2/2007 |
| JP | 2007-106621 | 4/2007 |
| JP | 2007-153363 | 6/2007 |
| JP | 4159956 | 10/2008 |
| JP | 4173388 | 10/2008 |
| JP | 2009108421 | 5/2009 |
| JP | 2010-202908 | 9/2010 |
| JP | 4564328 | 10/2010 |
| JP | 2011-116456 | 6/2011 |
| JP | 4757022 | 8/2011 |
| JP | 2011-208273 | 10/2011 |
| JP | 2011-526232 | 10/2011 |
| JP | 2012-192984 | 10/2012 |
| JP | 5290569 | 9/2013 |
| JP | 5323757 | 10/2013 |
| JP | 5597333 | 10/2014 |
| JP | 5855233 | 2/2016 |
| JP | 5887340 | 3/2016 |
| RU | 2221891 | 1/2004 |
| UA | 44247 | 2/2002 |
| UA | 29644 | 2/2007 |
| UA | 28415 | 12/2007 |
| WO | WO 92/04477 | 3/1992 |
| WO | WO 93/17864 | 9/1993 |
| WO | WO 96/15865 | 5/1996 |
| WO | WO 96/28582 | 9/1996 |
| WO | WO 97/38146 | 10/1997 |
| WO | WO 97/46726 | 12/1997 |
| WO | WO 98/46488 | 10/1998 |
| WO | WO 99/18250 | 4/1999 |
| WO | WO 99/32363 | 7/1999 |
| WO | WO 99/37826 | 7/1999 |
| WO | WO 00/03933 | 1/2000 |
| WO | WO 2004/094679 | 11/2004 |
| WO | WO 2008/002899 | 1/2008 |
| WO | WO 2008/103629 | 8/2008 |
| WO | WO 2010/117009 | 10/2010 |
| WO | WO 2011/078057 | 8/2011 |
| WO | WO 2012/133391 | 10/2012 |
| WO | WO 2012/144490 | 10/2012 |
| WO | WO 2013/040339 | 3/2013 |

OTHER PUBLICATIONS

Notice of Allowance tor Canada Patent Application No. 3,040,764, dated Jan. 21, 2021, 1 page.
Official Action for Mexico Patent Application No. MX/a/2016/008664, dated Jan. 27, 2021, 4 pages.
Official Action (with English translation) for India Patent Application No. 20197027888, dated Feb. 10, 2021, 6 pages.
Cotell et al., "Surface Engineering of Aluminum and Aluminum Alloys," ASM Handbook, vol. 5: Surface Engineering, 1994, pp. 784-804.
Official Action for Canadian Patent Application No. 3048957, dated Nov. 19, 2020, 4 pages.
Official Action (no English translation available) for Algerian Patent Application No. 190369, dated Dec. 21, 2020, 1 page.
Official Action for European Patent Application No. 16829052.6, dated Oct. 9, 2020, 5 pages.
Official Action for India Patent Application No. 201918037015, dated Dec. 2, 2020 5 pages.
Official Action (no English translation available) for Panama Patent Application No. 90904, dated Oct. 29, 2020 3 pages.
Official Action for U.S. Appl. No. 15/826,394, dated Dec. 21, 2020 16 pages.
Intent to Grant European Patent Application No. 16189165.0, dated Oct. 12, 2020, 39 pages, dated Dec. 12, 2020, 39 pages.
"Aluminium in the Packaging Industry: Manufacture, Use, Recycling," Gesamtverband Der Aluminium Industrie e.V., 2006, 16 pages [retrieved online from: www.aluinfo.de/files/_media/dokumente/Downloads/Technische%20Daten/Merkblaetter/W18_Aluminium_in_the_Packaging_Industry.pdf].
"Impact Extrusion," Wikipedia, Dec. 9, 2009 retrieved from https://web.archive.org/web/20091209012819/http://en.wikipedia.org/wiki/Impact_extrusion, 5 pages.
Cui et al. "Recycling of automotive aluminum," Transactions of Nonferrous Metals Society of China, Nov. 2010, vol. 20, No. 11, pp. 2057-2063.
Fisher et al. "Recycling—The Effect On Grain Refinement of Commercial Aluminum Alloys," London & Scandinavian Metallurgical Co Limited, 122nd TMS Annual Meeting & Exhibition, Feb. 21-25, 1993, 6 pages.
Goltz "Aluminum Bottles are Successful," University of Wisconsin, 2005, 5 pages [retrieved from: http://www2.uwstout.edu/content/rs/2005/article6.pdf].
Guley et al. "Direct recycling of 1050 aluminum alloy scrap material mixed with 6060 aluminum alloy chips by hot extrusion," International Journal of Material Forming, Apr. 2010, vol. 3, No. Suppl. 1, pp. 853-856.
Herbert, "Manufacturing Processes," Prentice-Hall, Inc., Englewood Cliffs, NJ, excerpts from pp. 548-553, 562-563, 1979, 11 pages.
Sanders, Jr. "Technology Innovation in Aluminum Products," JOM, Feb. 2001, vol. 53, No. 2, pp. 21-25 (pp. 21-22).
Tekkaya et al. "Hot profile extrusion of AA-6060 aluminum chips," Journal of Materials Processing Technology, Apr. 2009, vol. 209, No. 7, pp. 3343-3350.
International Search Report and Written Opinion for International Patent Application No. PCT/US12/55390, dated Nov. 21, 2012, 8 pages.
International Preliminary Report on Patentability for International (PCT) Patent Application No. PCT/US2012/055390, dated Mar. 27, 2014 8 pages.
Official Action for Australia Patent Application No. 2012308416, dated Jul. 3, 2015 3 pages.
Official Action for Australia Patent Application No. 2012308416, dated Apr. 13, 2016 4 pages.
Notice of Acceptance for Australia Patent Application No. 2012308416, dated Jul. 5, 2016 2 pages.
Official Action for Australia Patent Application No. 2016204457, dated Oct. 6, 2017 3 pages.
Official Action for Australia Patent Application No. 2016204457, dated Sep. 3, 2018 3 pages.
Official Action for Australia Patent Application No. 2018241184, dated Dec. 17, 2019 3 pages.
Notice of Allowance for Australia Patent Application No. 2018241184, dated May 18, 2020 4 pages.
Official Action with English Translation for Brazil Patent Application No. BR112014006382-6, dated Mar. 23, 2018 14 pages.
Official Action with English Translation for Brazil Patent Application No. BR112014006382-6, dated Jan. 18, 2019 7 pages.
Official Action for U.S. Patent Application No. BR122018017039-5, dated Apr. 11, 2019 9 pages.
Official Action with English Translation for Brazil Patent Application No. BR122018017039-5, dated Nov. 5, 2019 9 pages.
Official Action (no English translation) for Brazil Patent Application No. BR122018017039-5, dated Mar. 4, 2020 4 pages.
Official Action for Canada Patent Application No. 2,848,846, dated Feb. 19, 2016 6 pages.
Official Action for Canada Patent Application No. 2,848,846, dated Dec. 20, 2016 3 pages.

(56) References Cited

OTHER PUBLICATIONS

Official Action for Canada Patent Application No. 2,848,846, dated Oct. 18, 2017 5 pages.
Official Action for Canada Patent Application No. 2,848,846, dated Apr. 27, 2018 3 pages.
Notice of Allowance for Canada Patent Application No. 2,848,846, dated Feb. 5, 2019.
Official Action for Canada Patent Application No. 2,979,863, dated Sep. 21, 2018 6 pages.
Notice of Allowance for Canada Patent Application No. 2,979,863, dated May 15, 2019 1 page.
Official Action with English Translation for China Patent Application No. 201280045120.2, dated Jul. 21, 2015 19 pages.
Official Action (English Translation) for China Patent Application No. 201280045120.2, dated Jan. 15, 2016 10 pages.
Official Action (with English Translation) for China Patent Application No. 201280045120.2, dated Aug. 3, 2016 23 pages.
Official Action with English Translation for China Patent Application No. 201280045120.2, dated Mar. 23, 2017 19 pages.
Notice of Reexamination with English Translation for China Patent Application No. 201280045120.2, dated Mar. 22. 2018 22 pages.
Notice of Reexamination with English Translation for China Patent Application No. 201280045120.2, dated Aug. 28, 2018 24 pages.
Reexamination Decision for China Patent Application No. 201280045120.2, dated Mar. 20, 2019 19 pages.
Official Action (with English translation) for Chinese Patent Application No. 201910531300.5, dated Aug. 18, 2020, 19 pages.
Extended Search Report for European Patent Application No. 12831344.2, dated Feb. 5, 2016 10 pages.
Official Action for European Patent Application No. 12831344.2, dated Dec. 13, 2017 4 pages.
Official Action for European Patent Application No. 12831344.2, dated Sep. 28, 2018 4 pages.
Official Action for European Patent Application No. 12831344.2, dated Jul. 24, 2019 4 pages.
Official Action for European Patent Application No. 12831344.2, dated Apr. 30, 2020 3 pages.
Extended Search Report for European Patent Application No. 16189160.1, dated Feb. 20, 2017 9 pages.
Official Action for European Patent Application No. 16189160.1, dated Jan. 24, 2018 4 pages.
Official Action for European Patent Application No. 16189160.1, dated Jan. 2, 2019 4 pages.
Summons to Attend Oral Proceedings for European Patent Application No. 16189160.1, dated Oct. 11, 2019 4 pages.
Intent to Grant European Patent Application No. 16189160.1, dated Jun. 5, 202 5 pages.
Extended Search Report for European Patent Application No. 16189165, dated Feb. 10, 2017 7 pages.
Official Action tor European Patent Application No. 16189165.0, dated Jan. 23, 2018 4 pages.
Official Action for European Patent Application No. 16189165.0, dated Oct. 17, 2018 4 pages.
Official Action for European Patent Application No. 16189165.0, dated Jun. 7, 2019 4 pages.
Summons to Attend Oral Proceedings for European Patent Application No. 16189165.0, dated Dec. 11, 2019, 2 pages.
Official Action with English Translation for Indonesia Patent Application No. P00201804102, dated Jan. 31, 2020 4 pages.
Official Action tor India Patent Application No. 2983/DELNP/2014, dated Mar. 5, 2019 6 pages.
Official Action with English Translation for So, Korean Patent Application No. 10-2014-7010144, dated Oct. 20, 2015 11 pages.
Official Action with English Translation for So. Korean Patent Application No. 10-2014-7010144, dated May 10, 2016 9 pages.
Official Action with English Translation for So. Korean Patent Application No. 10-2014-7010144, dated Sep. 7, 2016 8 pages.
Official Action with English Summary for Korea Patent Application No. 10-2016-7021608 dated Oct. 27, 2017 11 pages.
Official Action with English Summary for Korea Patent Application No. 10-2016-7027755, dated Dec. 8, 2016 9 pages.
Official Action with English Summary for Korea Patent Application No. 10-2016-7027755, dated May 29, 2017 10 pages.
Notice of Allowance with English Translation for Korea Patent Application No. 10-2016-7027755, dated Oct. 27, 2017 4 pages.
Official Action for Mexican Patent Application No. MX/a/2014/002907, dated Apr. 29, 2016 3 pages (English translation unavailable).
Notice of Allowance for Mexican Patent Application No. MX/a/2014/002907, dated Jul, 8, 2016, 1 page (English translation unavailable).
Official Action with English Translation for Russian Patent Application No. 2014115212, dated Oct. 21, 2015 8 pages.
Decision on Grant with English Translation for Russia Patent Application No. 2014115212/02, dated Mar. 18, 2016 15 pages.
Official Action with English Translation for Ukraine Patent Application No. a 2014 04043, dated Jan. 16, 2016 11 pages.
Decision to Grant with English Translation for Ukraine Patent Application No. a201404043, dated Mar. 14, 2017 10 pages.
Official Action with English Translation for Vietnam Patent Application No. 1-2014-01220, dated Jun. 4, 2019 4 pages.
Decision to Grant (with English Translation) Vietnam Patent Application No. 1-2014-01220, dated May 25, 2020 2 pages.
Official Action with English Translation for Saudi Arabia Patent Application No. 112330856, dated Dec. 14, 2015 8 pages.
Official Action for Saudi Arabia Patent Application No. 112330856, dated Mar. 8, 2017 4 pages.
Official Action (with English translation) for Saudi Arabia Patent Application No. 112330856, received Jan. 24, 2017 7 pages.
International Search Report and Written Opinion for International Patent Application No. PCT/US16/69454, dated Jul. 28, 2017, 11 pages.
International Preliminary Report on Patentability for International (PCT) Patent Application No. PCT/US2016/069454, dated Jul. 11, 2019 7 pages.
Official Action for Australian Patent Application No. 2016433840, dated Dec, 2, 2019, 4 pages.
Official Action for Australian Patent Application No. 2016433840, dated Jul. 29, 2020, 4 pages.
Notice of Acceptance for Australian Patent Application No. 2016433840, dated Oct. 2, 2020, 4 pages.
Official Action with English Translation for Brazil Patent Application No. BR112019013568-5, dated Mar. 12, 2020 5 pages.
Official Action (with English translation) for Russia Patent Application No. 2019123823, dated Feb. 10, 2020 2 pages.
Decision to Grant (No English translation) for Russia Patent Application No. 2019123823, dated Feb. 10, 2020 11 pages.
International Search Report and Written Opinion for International (PCT) Patent Application No. PCT/US2014/033182, dated Nov. 25, 2014, 11 pages.
International Preliminary Report on Patentability for International (PCT) Patent Application No. PCT/US2014/033182, dated Oct. 22, 2015, 8 pages.
Official Action for Australia Patent Application No. 2014251206, dated Jun. 9, 2017 5 pages.
Official Action for Canadian Patent Application No. 2,908,181, dated Sep. 26, 2016 6 pages.
Notice of Allowance for Canadian Patent Application No. 2,908,181, dated Jun. 21, 2017 1 page.
Official Action for Canada Patent Application No. 2,990,040, dated Oct. 29, 2018 4 pages.
Official Action for Canada Patent Application No. 2,990,040, dated May 16, 2019 4 pages.
Official Action for Canada Patent Application No. 2,990,040, dated Jan. 24, 2020 4 pages.
Official Action for Canada Patent Application No. 2,990,040, dated Sep. 4, 2020 4 pages.
Official Action (English Translation) for Chinese Patent Application No. 201480032990.5, dated Aug. 31, 2016 8 pages.
English Translation of Office Action for China Patent Application No. 2017052201683100, dated May 25, 2017 3 pages.

(56) References Cited

OTHER PUBLICATIONS

Notice of Allowance (with English Translation) for China Patent Application No. 2017052201683100, dated Sep. 27, 2017 5 pages.
Official Action for Colombian Patent Application No. 15-265549, dated Dec. 1, 2015.
English Translation of Official Action for Colombia Patent Application No. 15-265549, dated Jul. 7, 2017 3 pages.
Partial Supplementary Search Report for European Patent Application No. 14782344.7, dated Mar. 29, 2017 16 pages.
Extended European Search Report for European Patent Application No. 14782344.7, dated Sep. 13, 2017 16 pages.
Official Action for European Patent Application No. 14782344.7, dated Feb. 24, 2020 4 pages.
Official Action for India Patent Application No. 8993/DELNP/2015, dated Apr. 16, 2019 9 pages.
Official Action for Japan Patent Application No. 2016-507586, dated Aug. 8, 2017 3 pages.
Notice of Allowance with English Translation for Japan Patent Application No. 2016-507586, dated Nov. 1, 2017 2 pages.
Official Action with English Translation for Russia Patent Application No. 2015147899, dated Apr. 17, 2017 11 pages.
Official Action (English Translation) for Russia Patent Application No. 2015147899, dated Aug. 23, 2017 5 pages.
Official Action (English translation) for Vietnamese Patent Application No. 1-2015-04151, dated Jul. 20, 2020, 2 pages.
Official Action for U.S. Appl. No. 13/617,119, dated Aug. 6, 2015 6 pages Restriction Requirement.
Official Action for U.S. Appl. No. 13/617,119, dated Sep. 24, 2015 7 pages.
Notice of Allowance for U.S Appl. No. 13/617,119, dated Mar. 3, 2016 10 pages.
Official Action for U.S. Appl. No. 13/617,119, dated Jun. 8, 2016 8 pages.
Official Action for U.S. Appl. No. 13/617,119, dated Oct. 18, 2016 9 pages.
Notice of Allowance for U.S. Appl. No. 13/617,119, dated Mar. 24, 2017 9 pages.
Official Action for U.S. Appl. No. 15/098,654, dated Sep. 24, 2018 6 pages Restriction Requirement.
Official Action for U.S. Appl. No. 15/098,654, dated Jan. 7, 2019 7 pages.
Official Action for U.S. Appl. No. 15/098,654, dated Jun. 24, 2019 8 pages.
Notice of Allowance for U.S. Appl. No. 15/098,654, dated Oct. 18, 2019 8 pages.
Official Action for U.S. Appl. No. 14/246,728, dated Oct. 19, 2015 6 pages Restriction Requirement.
Official Action for U.S. Appl. No. 14/246,728, dated Jan. 14, 2016 16 pages.
Final Action for U.S. Appl. No. 14/246,728, dated May 26, 2016 11 pages.
Notice of Allowance for U.S. Appl. No. 14/246,728, dated Aug. 15, 2016 8 pages.
Notice of Allowance for U.S. Appl. No. 15/279,127, dated Aug. 4, 2017 10 pages.
Official Action for U.S. Appl. No. 15/826,394, dated Jan. 28, 2020 6 pages Restriction Requirement.
Official Action for U.S. Appl. No. 15/826,394, dated Jun. 26, 2020 12 pages.
Official Action (with English translation) for Chinese Patent Application No. 201910531300.5, dated Apr. 14, 2021, 34 pages.
Office Action for European Patent Application No. 12831344.2, dated Mar. 31, 2021, 3 pages.
Notice of Allowance for Canada Patent Application No. 2,990,040, dated Mar. 3, 2021 1 page.
Summons to Attend Oral Proceedings for European Patent Application No. 14782344.7, dated Apr. 23, 2021, 4pages.
Guanglin et al., "Packaging Material Science," Aug. 31, 2011, pp. 243-244 (No English translation available).
Xiao et al., "Practical Manual of Aluminum Processing Technology," Metallurgical Industry Press, Beijing, China, 2005, 14 pages (No English translation avaiiabie).
Official Action for Australia Patent Application No. 2020239684, dated Aug. 27, 2021, 4 pages.
Official Action with English Translation for Brazil Patent Application No. BR112019013568-5, dated Jul. 26, 2021 9 pages.
Official Action for European Patent Application No. 16829052.6, dated Jul. 30, 2021, 3 pages.
Notice of Allowance for Australian Patent Application No. 2020230322, dated Nov. 16, 2021, 4 pages.
Official Action (with English translation) for Chinese Patent Application No. 201910531300.5, dated Dec. 7, 2021, 22 pages.
Intent to Grant European Patent Application No. 12831344.2, dated Jan. 7, 2022, 40 pages.
Official Action for Canadian Patent Application No. 3048957, dated Dec. 15, 2021, 4 pages.
Official Action for U.S. Appl. No. 16/809,420, dated Dec. 7, 2021, 10 pages.
Official Action (with English translation) for Brazil Patent Application No. BR122020012460-1, received Aug. 3, 2021, 6 pages.
Intent to Grant Europe Patent Application No. 14782344.7, dated Nov. 11, 2021 7 pages.
Official Action (with English translation) for Chinese Patent Application No. 201910531300.5, dated Sep. 10, 2021, 13 pages.
Official Action for Mexico Patent Application No. MX/a/2016/008664, dated Aug. 10, 2021, 3 pages.
Notice of Allowance for Mexico Patent Application No. MX/a/2015/013932, dated Sep. 13, 2021, 2 pages.
Official Action for U.S. Appl. No. 16/809,420, dated Aug. 20, 2021, 7 pages.
"Aerobal "World Aluminum Aerosol Can Award 2010" Stylish can design and "greener" production technology," Unipak, Sep. 27, 2010, 1 page.
"Aerocan and Tubex pick up 2010 aluminium aerosol can awards," Cosmetics Business, Sep. 28, 2010 retrieved from https://www.cosmeticsbusiness.com/news/article_page/Aerocan_and_Tubex_pick_up_2010_aluminium_aerosol_can_awards/56955, 1 page.
"DIN EN 573-3," DIN, Aug. 2009, 3 pages.
"International Alloy Designations and Chemical Composition Limits for Wrought Aluminum and Wrought Aluminum Alloys," The Aluminum Association, Feb. 2009, 37 pages.
Notices of Opposition filed in Europe Patent Application No. 16189160.1, dated Aug. 4, 2021, 26 pages.
Official Action for India Patent Application No. 201918034863, dated Jul. 13, 2021 6 pages.
Official Action for India Patent Application No. 201918034864, dated Aug. 3, 2021 6 pages.
Official Action for Canadian Patent Application No. 3048957, dated Jun, 7, 2021, 4 pages.
Official Action for Indonesia Patent Application No. PID201906548, dated May 19, 2021, 2 pages.
Official Action for Mexico Patent Application No. MX/a/2015/013932, dated Jun. 18, 2021, 6 pages.
"Casthouse Seminar, Fourth edition 1998," Alusuisse Technology & Management Ltd., 1998, 13 pages.
Altenpohl, "Aluminium und Aluminiumlegierungen," Springer-Verlag, Berlin, 1965, pp. 24-33.
Lange et al., "Fließpressen," Springer, 2008, pp. 94-95.
Siegert, "Fließpressen von Aluminium, Band 1" Institut Für Umformtechnik Universtität Stuttgart, Informationsgesellschaft/Verlag, Oct. 6, 1995, p. 183.
Taschauer, "Werkstoffkundliche und verfahrenstechnische Einflusse bei der Herstellung von Aluminium-Aerosolspraydosen," Studienrichtung Werkstoffwissenschaft, Leoben, Nov. 2009, 116 pages.
Taschauer et al., "Einflüsse Auf Die Umformbarkeit Von Aerosolspraydosen," in 4. Sommerschule Umformtechnik Kaltumformung, Jun. 2006, pp. 125-130.
Official Action (with English translation) for Argentina Patent Application No. P180101150, dated Oct. 21, 2021, 15 pages.
Letter from the Opponent filed in Europe Patent Application No. 16189160.1, dated Apr. 5, 2022, 20 pages.

(56) References Cited

OTHER PUBLICATIONS

Notice of Opposition for Europe Patent Application No. 16/189165.0, dated Mar. 4, 2022, 15 pages.
Notice of Allowance for Mexico Patent Application No. MX/a/2016/008664, dated Feb. 17, 2022, 2 pages.
Official Action for Brazil Patent Application No. BR112019013568-5, dated Dec. 14, 2021, 5 pages.
Official Action (with English translation) for Brazil Patent Application No. BR122020012460-1, dated Jan. 18, 2022, 7 pages.

* cited by examiner

ALUMINUM ALLOY FOR IMPACT EXTRUDED CONTAINERS AND METHOD OF MAKING THE SAME

CROSS REFERENCE TO RELATED APPLICATIONS

This application is a national stage application under 35 U.S.C. 371 of PCT Application No. PCT/US2016/69454, having an international filing date of Dec. 30, 2016, which designated the United States, which is incorporated herein by reference in its entirety.

CROSS-REFERENCE TO RELATED APPLICATION

This application is related to U.S. patent application Ser. No. 13/617,119, filed on Sep. 14, 2012, which is incorporated herein by this reference in its entirety.

FIELD OF THE INVENTION

The present invention relates generally to alloys, including those made by combining two aluminum alloy materials, which can be recycled materials, used in the manufacturing of aluminum containers by a process known as impact extrusion. More specifically, the present invention relates to methods, apparatus and alloy compositions used in the manufacturing of slugs used to make containers and other articles from impact extrusion.

BACKGROUND

Impact extrusion is a process utilized to make metallic containers and other articles with unique shapes. The products are typically made from a softened metal slug comprised of steel, magnesium, copper, aluminum, tin or lead. The container is formed inside the confining die from a cold slug which is contacted by a punch. The force from the punch deforms the metal slug around the punch on the inside, and the die along the outside surface. After the initial shape is formed, the container or other apparatus is removed from the punch with a counter-punch ejector, and other necking and shaping tools are used to form the device to a preferred shape. Traditional impact extruded containers include aerosol containers and other pressure vessels which require high strength, and thus use thicker gage and heavier materials than traditional aluminum beverage containers. Because of the thickness and strength requirements of these containers, the cost to manufacture the containers may be significant when compared to conventional or drawn and ironed metal beverage containers, which generally utilize 3104 aluminum. In a conventional impact extrusion process, almost pure or "virgin" aluminum is used due to its unique physical characteristics, and is commonly referred to as "1070" or "1050" aluminum which is comprised of at least about 99.5% of pure aluminum.

Due to the complexity of creating complex shapes with soft metals such as aluminum, critical metallurgical characteristics must be present for the impact extrusion process to work. This includes, but is not limited to the use of very pure, soft aluminum alloys, which typically contain at least about 99% pure virgin aluminum. Because of this requirement, the use of recycled materials, for example aluminum alloys 3104, 3105, or 3004 scrap aluminum, have not been feasible for use in the impact extrusion process for aerosol and beverage containers.

Thus, there is a significant need to find a lightweight yet strong aluminum alloy to form impact extruded containers and other useful articles, and to utilize scrap aluminum from other manufacturing processes to benefit the environment and save valuable natural resources.

SUMMARY OF THE INVENTION

Accordingly, the present invention contemplates a novel system, device, and methods for using scrap aluminum materials including aluminum alloy 3XXX series, such as 3104, 3004, 3003, 3013, 3103 and 3105 aluminum, in combination with other metal materials to create a unique and novel aluminum alloy. Other combinations of aluminum metals could be used so long as the resulting aluminum is within the ranges of the recycled aluminum discussed below. The novel alloy can be used during an impact extrusion process to form various shaped containers and other articles.

Although generally referred to herein as "containers" it should be appreciated that the current process and alloy compositions may be used in the impact extrusion process to form any variety of shaped containers or other articles of manufacture. Containers hold a material, which can be a liquid, a solid, a gas or combinations thereof. It is important to note that containers, as used herein, do not dissipate a liquid, solid or gas. For example, a heat shield would not be a container as used herewith because the heat shield would be used to dissipate heat rather than contain the heat. In some embodiments, a container can be a beverage container or an aerosol container. In some embodiments, the container can be adapted to receive an end closure. An end closure can be attached to a single side of the container resulting in a closed container, which is capable of holding pressure up to about 100 psi, or more.

The term "relatively pure", "pure", or "prime" aluminum alloy refers to an aluminum alloy material that is not recycled. Prime, pure, or relatively pure materials can include scrap metals, including, for example, the material remaining after slugs are punched from a slab. In some embodiments, the prime aluminum alloy can be P1020A, aluminum alloy 1050 or aluminum alloy 1070.

Thus, in one embodiment of the present invention, a novel alloy is provided in the initial form of a metal slug to form a metallic container in an impact extrusion process. The alloy in one embodiment has a composition comprising a recycled 3105 or 3104 aluminum, and a relatively pure 1070 aluminum to form a novel recycled alloy. In one embodiment, a recycled aluminum alloy which utilizes about 40% of 3104 alloy is blended with a 1070 alloy, and which comprises the following composition:

approximately 98.47% aluminum
approximately 0.15% Si;
approximately 0.31% Fe;
approximately 0.09% Cu;
approximately 0.41% Mn;
approximately 0.49% Mg;
approximately 0.05% Zn;
approximately 0.02% Cr; and
approximately 0.01% Ti.

As provided in the tables, claims, and detailed description below, various compositions of aluminum alloys are provided and contemplated herein. For each alloy, the amount of each component, i.e., Si, Fe, Cu, etc. may be varied approximately 15% to achieve satisfactory results. Furthermore, as appreciated by one skilled in the art, it is not necessary that the novel alloy compositions described herein and used in the impact extrusion process be comprised entirely or in part with recycled components and alloys. Rather, the alloys may be obtained and blended from stock materials which have not previously been used or implemented in previous products or processes. Similarly, a combination of recycled materials can be used to form a new alloy.

In another aspect of the present invention, a novel manufacturing process may be provided to form the unique alloys, and includes but is not limited to the blending of various scrap materials with other virgin alloys to create a unique alloy specifically adapted for use in an impact extrusion process.

In another aspect of the present invention, specific tools such as neckers and other devices commonly known in the container manufacturing business are contemplated for use with the novel alloys and which are used in conjunction with the impact extrusion process. Further novel manufacturing techniques associated with using the novel alloy compositions are also contemplated with the present invention.

In yet another aspect of the present invention, a distinctly shaped container or other article is provided which is comprised of one or more of the novel alloys provided and described herein. Although these containers are most suitable for aerosol containers and other types of pressure vessels, the compositions and processes described herein may be used to make any type of shaped metallic container.

One aspect of the present invention is an aluminum alloy used in a slug for an impact extrusion process to form a metallic container. The container can receive an end closure to form a closed vessel capable of retaining pressure. The composition of the aluminum alloy includes at least about 97.56 wt. % Al, at least about 0.08 wt. % Si, at least about 0.22 wt. % Fe, at least about 0.04 wt. % Mn, at least about 0.02 wt. % Mg, and at most about 0.15 total wt. % impurities.

Another aspect of the present invention is a method to produce a container. The method includes impact extruding a slug to form a container adapted to receive an end closure and retain pressure within the container. The slug includes an aluminum alloy of the composition of at least about 97.56 wt. % Al, at least about 0.08 wt. % Si, at least about 0.22 wt. % Fe, at least about 0.04 wt. % Mn, at least about 0.02 wt. % Mg, and at most about 0.15 total wt. % impurities.

Another aspect of the present invention is a container made from an impact extrusion process and which is comprised of a novel aluminum alloy made at least partially with a recycled scrap material. The container includes a body, which has a diameter between about 0.86 inches and about 3 inches, a height between about 2.3 inches and about 8.5 inches, and a thickness of a wall between about 0.003 inches and about 0.16 inches. A material of the container includes at least about 97.56 wt. % Al, at least about 0.08 wt. % Si, at least about 0.22 wt. % Fe, at least about 0.04 wt. % Mn, at least about 0.02 wt. % Mg, and at most about 0.15 total wt. % impurities.

Another aspect of the present invention is a metal container adapted to receive an end closure which is formed in an impact extrusion process from a slug made at least partially from a recycled aluminum alloy.

In various embodiments of the present invention, lightweight containers comprising recycled contents are provided. At least one of the following advantages may be realized: strength to weight ratio; burst pressures; deformation pressures; dent resistance; resistance to scratching or galling; and/or reduction in weight and metal content. Other advantages are also contemplated. Furthermore, aspects and features of the present invention provide for containers with increased resistance to back annealing allowing higher cure temperature lining materials. In various embodiments, an alloy for producing impact extruded containers with higher back annealing resistance is contemplated, resulting in improved container performance, and utilizing coatings requiring higher curing temperatures. Container designs and tooling designs for producing such containers are also contemplated.

In various embodiments of the present invention, an aluminum slug and corresponding impact extruded container comprising recycled material is provided. The recycled content may be post-industrial or post-consumer content, the use of which enhances overall product and process efficiency. A significant portion of known scrap, such as offal from cup making processes, contains a higher concentration of alloying elements than the base 1070 alloy currently used. These alloying elements, while providing various cost and environmental advantages, modify the metallurgical characteristics of the aluminum. For example, inclusion of these elements increases the solidification temperature range. Casting challenges are thus present. As yield strength increases and the ductility decreases, issues are created with respect to rolling the strip, for example. Recrystallization characteristics are known to change, necessitating potential changes to the thermomechanical treatment(s), including but not limited to: rolling temperatures, rolling reductions, annealing temperatures, annealing process, and/or annealing times. The increased ultimate tensile strength and yield strength increases the tonnage loads when punching slugs.

Additionally, surface roughness and lubrication of the slugs of the present invention is critical due to the modified metallurgical characteristics. Tonnage loads on the extrusion presses are typically higher in connection with slugs of the present invention. In various embodiments, the increased material strength of the present invention enables attainment of standard container performance specifications at significant lower container weights and/or wall thicknesses.

Thus, in one aspect of the present invention a method of manufacturing a slug used in an impact extrusion process from recycled scrap material is provided, and comprising:

providing a scrap metal comprising at least one of a 3104, a 3004, 3003, 3013, 3103 and a 3105 aluminum alloy;

blending said at least one of said 3104, said 3004, said 3003, said 3013, said 3103 and said 3104 aluminum alloy with a relatively pure aluminum alloy to create a recycled aluminum alloy;

adding a titanium boride material to said recycled aluminum alloy;

forming a slug with said recycled aluminum alloy after heating;

deforming said slug comprised of said recycled aluminum alloy into a preferred shape in an impact extrusion process to form a shaped container.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the Summary of the Invention is neither intended nor should it be construed as being representative of the full extent and scope of the present invention. The present invention is set forth in various levels of detail in the Summary of the Invention, as well as, in the attached drawings and the Detailed Description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

DETAILED DESCRIPTION

Figure 1:
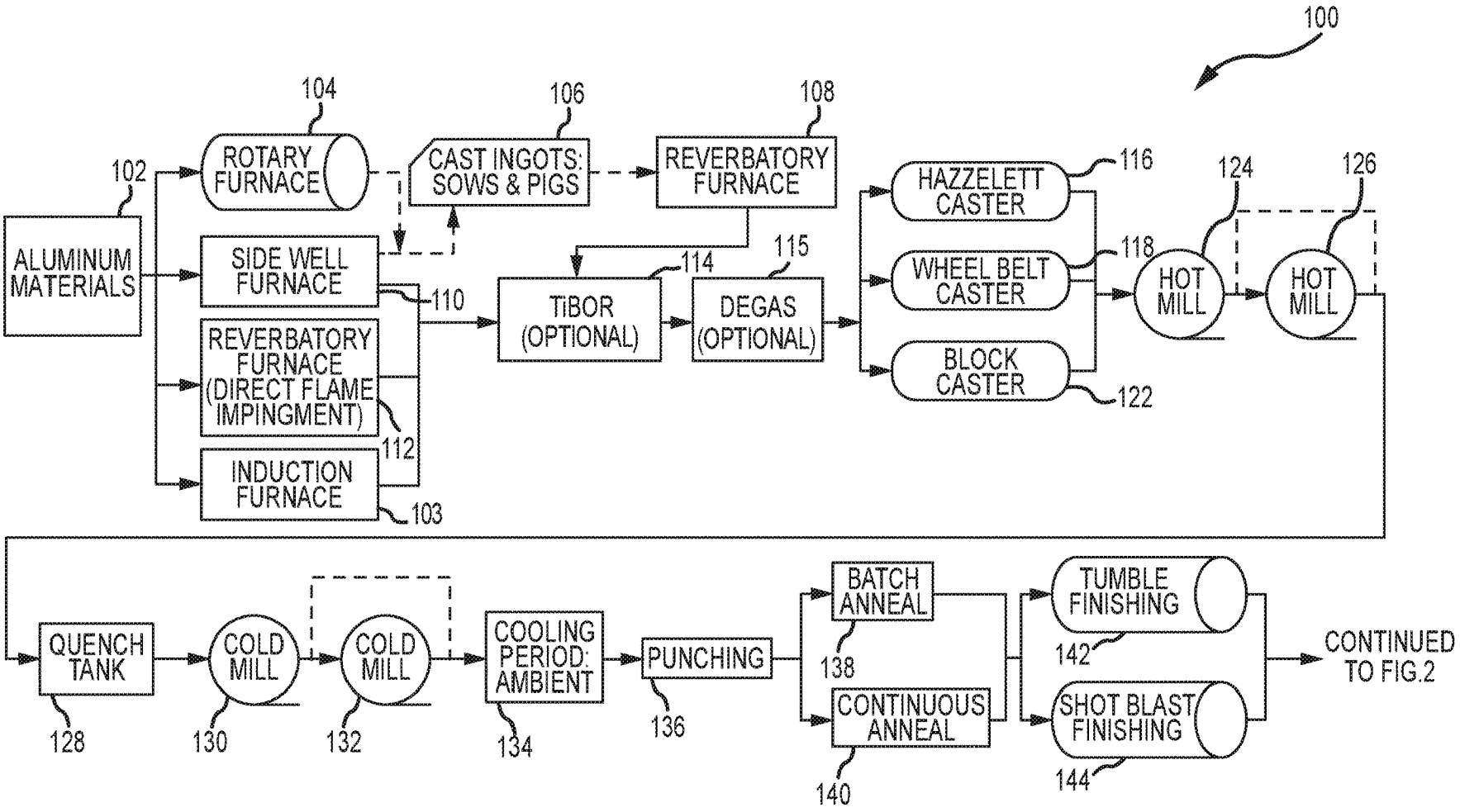
FIG. 1 illustrates a method for manufacturing an alloy slug from a recycled aluminum material.

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

The containers made from the alloys of the present invention meet the burst requirements set forth by jurisdictional regulations, while being pliable enough to be formed using impact extrusion. Unexpectedly, the containers of the present invention can be light weighted (i.e. walls and bottom thickness can be thinned) and still meet the burst requirements, where cans made from conventional materials (i.e. 1070 or 1050) cannot. Light weighting the containers is both financially and environmentally beneficial.

Although the following text sets forth a detailed description of numerous different embodiments, it should be understood that the legal scope of the description is defined by the words of the claims set forth at the end of this disclosure. The Detailed Description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as not to confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Composition

As provided in the attached tables and text, various aluminum alloys are identified by numerical indications such as 1070 or 3104. As appreciated by one skilled in the art, aluminum is designated by its major corresponding alloying elements, typically in four-digit arrangement. The first of these four numbers correspond to a group of aluminum alloys sharing a major alloying element, such as 2XXX for copper, 3XXX for manganese, 4XXX for silicon, etc. Thus, any references to the various aluminum alloys are consistent with the designations used throughout the aluminum and container manufacturing industry.

Referring now to the following tables, figures and photographs, a novel recycled aluminum alloy is provided for use in a metallic slug used in an impact extrusion process to manufacture shaped metal containers and other apparatus. In certain instances, details that are not necessary for an understanding of the invention or that render other details difficult to perceive may have been omitted from these drawings, photographs and charts. It should be understood, of course, that the invention is not limited to the particular embodiments illustrated in the drawings.

In many of the charts and examples provided below, the term "ReAl", or "RE", etc. may be used to identify a particular alloy. The term "ReAl" or "RE" is merely an identifier for a metal containing a combination of more than one aluminum alloy. In some embodiments, at least one of the alloy materials can be from recycled materials such as container or end closure scrap. In some instances, 3104 aluminum alloy commonly known in the art is combined with another material, typically P1020A, 1070 aluminum alloy, or 1050 aluminum alloy. The number and percentage used after "ReAl" identifies the percent of the recycled alloy or secondary alloy, which is combined with a prime or unrecycled aluminum alloy to form the new alloy used in an impact extrusion process. It would be understood by one having skill in the art that both materials can be recycled without deviating from the invention. For example, ReAl 3104 30% or RE 3104-30 identifies that 30 wt. % of a 3104 alloy has been combined with up to about 70 wt. % of a relatively pure 1070 aluminum alloy to form a new alloy having the metallurgical composition of Si, Fe, Cu, etc.

provided in the charts. Other charts refer to the number "3105" and a percentage of that alloy provided in a given alloy, such as 20% or 40%. Similar to the 3104 alloy, the term "3105" is an aluminum alloy well known by those skilled in the art, and the 20% or 40% reflects the amount of that alloy which is mixed with a 1070 aluminum alloy to form the new alloy which is used in the metal slug and the impact extrusion process to manufacture a container such as an aerosol can. Although not provided in the chart below, it is also feasible to use scrap material or non scrap aluminum ingots in the process to create new alloys. Furthermore, previously made aluminum can be used in the aluminum alloy composition. For example, previously made ReAl 3104 30% can be combined with prime aluminum, a secondary material, and/or a doping agent to form a different recycled aluminum alloy, e.g. ReAl 3104 40%, or more of the same recycled aluminum alloy, e.g. ReAl 3104 30%.

Between about 40 wt. % and about 90 wt. % of a prime aluminum can be combined with between about 10 wt. % and about 60 wt. % of a secondary material, which can be a recycled material. Furthermore, the prime aluminum can also be recycled or can be from scrap materials. Other alloy materials, in addition to two primary alloy materials, can also be added to produce a suitable new alloy composition.

Table 1 below identifies one example of the various compositions of the alloys discussed herein. These values are consistent with the International Alloy Designations and Chemical Composition Limits for Wrought Aluminum and Wrought Aluminum Alloys (revised in January 2015), and may also be consistent with earlier versions of the International Designation. The US designations are provided below (unless otherwise stated), but one skilled in the art would understand that designations in other jurisdictions are also acceptable. All wt. % values listed in the table are maximum and approximate values. The Canadian composition (P1020A) is also listed in Table 1, but it comes from the International Designations and Chemical Composition Limits for Unalloyed Aluminum (March 2007).

TABLE 1

| Element | AA3104 | AA3004 | AA3105 | AA3003 | AA1070 | AA1050 | P1020A |
|---|---|---|---|---|---|---|---|
| Si | 0.6 | 0.3 | 0.6 | 0.6 | 0.20 | 0.25 | 0.10 |
| Fe | 0.8 | 0.7 | 0.7 | 0.7 | 0.25 | 0.40 | 0.20 |
| Cu | 0.05-0.25 | 0.25 | 0.3 | 0.05-0.2 | 0.04 | 0.05 | — |
| Mn | 0.8-1.4 | 1-1.5 | 0.3-0.8 | 1-1.5 | 0.03 | 0.05 | — |
| Mg | 0.8-1.3 | 0.8-1.3 | 0.2-0.8 | — | 0.03 | 0.05 | — |
| Zn | 0.25 | 0.25 | 0.4 | 0.1 | 0.04 | 0.05 | 0.03 |
| Cr | — | — | 0.2 | — | — | — | — |
| Ti | 0.1 | — | 0.1 | — | — | 0.03 | — |
| V | — | — | — | — | 0.05 | 0.05 | 0.03 |
| Ga | 0.05 | — | — | — | — | — | 0.04 |
| Sn | 0.05 | — | — | — | — | — | — |
| Impurities (each) | 0.05 (0.15 total max) | 0.05 (0.15 total max) | 0.05 (0.15 total max) | 0.05 (0.15 total max) | 0.03 | 0.03 | 0.03 (0.10 total max) |
| Al (min) | 96.7 | 97.8 | 97.3 | Balance | 99.7 | 99.50 | Balance |

Impurities can include Ni, Ag, B, Bi, Ga, Li, Pb, Sn, V, Hg, Cd or Zr, or combinations thereof.

For the values below, the composition amount is based on the aluminum alloy compositions set forth in Table 1. One skilled in the art would understand how to calculate the composition of an alloy utilizing different combinations of alloying material without undue experimentation. Furthermore, different alloying names can be used in different jurisdictions similar alloying materials without deviating from the invention. Previously made aluminum alloy material can be combined with the aluminum alloy composition (s) and/or scrap aluminum alloy materials to form the compositions set forth in the Table examples below without deviating from the invention. To achieve the compositions set forth below, components can be added. By way of example only, if a combination of at least two alloying materials did not meet the magnesium composition, then magnesium can be added as an element or in an alloy form to increase the amount of magnesium in the end composition. The same theory applies to other materials listed in the tables below.

Table 2 provides an overall composition material range of alloy materials when P1020A, AA1050 or AA1070 are combined with AA3104, AA3004, AA3105, AA3003, or AA3103.

TABLE 2

| Element | Amount (wt. %) |
|---|---|
| Si | 0.07-0.46 |
| Fe | 0.22-0.58 |
| Cu | 0-0.2 |
| Mn | 0.04-0.92 |
| Mg | 0.02-0.74 |
| Zn | 0.02-0.26 |
| Cr | 0.02-0.13 |
| Ti | 0-0.05 |
| Al | 97.56-99.5 (or balance) |
| Impurities | 0-0.15 |

1070 in Combination

The tables below illustrate composition ranges of an aluminum alloy, where at least about 40 wt. % of aluminum alloy 1070, and wherein at most about 60 wt. % of a second material is used in an aluminum alloy composition. At least one material can be recycled material, or both materials can be pure or unrecycled. Impurities can also be present in the alloy composition. Impurities can include insoluble elements such as metallic elements or trace elements not specified in a registration for the alloying materials. The total amount of impurities should not exceed 0.15 wt. %. The amount of impurities in the composition can affect the maximum amount of aluminum in the composition, which can be the balance of the composition.

Table 3 illustrates composition ranges of an aluminum alloy, where at least about 40 wt. % of an aluminum alloy 1070, and wherein at most about 60 wt. % of a second material, 3104, is used in an aluminum alloy composition. At least one of the materials can be recycled material. Table 3A illustrates specific compositions of an aluminum alloy at different percentages. All values listed in the table are approximate values and the composition will be achieved if the amount of a component is +/−about 10% of the listed amount.

TABLE 3

| Element | Amount (wt. %) |
|---|---|
| Si | 0.07-0.2 |
| Fe | 0.22-0.38 |
| Cu | 0-0.13 |
| Mn | 0.11-0.61 |
| Mg | 0.13-0.73 |
| Zn | 0.02-0.07 |
| Cr | 0.02-0.03 |
| Ti | 0-0.03 |
| Al | 97.53-99.09 (or balance) |
| Impurities | 0-0.05 (each) |

TABLE 3A

| Element | 3104 10% | 3104 20% | 3104 30% | 3104 40% | 3104 50% | 3104 60% |
|---|---|---|---|---|---|---|
| Si | 0.08 | 0.1 | 0.13 | 0.15 | 0.18 | 0.2 |
| Fe | 0.22 | 0.25 | 0.28 | 0.31 | 0.34 | 0.38 |
| Cu | 0.03 | 0.05 | 0.07 | 0.09 | 0.11 | 0.13 |
| Mn | 0.11 | 0.21 | 0.31 | 0.41 | 0.51 | 0.61 |
| Mg | 0.13 | 0.25 | 0.37 | 0.49 | 0.61 | 0.73 |
| Zn | 0.02 | 0.03 | 0.04 | 0.05 | 0.06 | 0.07 |
| Cr | 0.02 | 0.02 | 0.02 | 0.02 | 0.02 | 0.03 |
| Ti | 0.01 | 0.01 | 0.01 | 0.01 | 0.01 | 0.01 |
| Al (balance) | 99.38 | 99.08 | 98.77 | 98.47 | 98.16 | 97.84 |
| Impurities (each) | 0.05 | 0.05 | 0.05 | 0.05 | 0.05 | 0.05 |

If titanium boride is added to the composition comprising 1070 and 3104, then the amount of boron in the composition may not show a discernable increase. In some embodiments, the amount of boron in the composition can increase by less than about 0.0006 wt. %. The amount of titanium in the composition may also not show a discernable increase, though there might be an increase by about 0.003-0.0055 wt. %. Even without a measurable effect on the composition, there can be an effect on the properties of the aluminum as discussed below.

Table 4 illustrates the average hardness (HB) for four samples made from a combination of 1070 and 3104, both before annealing and after annealing. Table 4 also illustrates the hardness of 1070 not combined with any other materials. The samples were about 45×5.5 mm (A) or about 53×6.5 mm (B).

TABLE 4

| Alloy | Alloy | Before annealing | After Annealing |
|---|---|---|---|
| A | 1070 | 41.2 | 19.8 |
| B | | — | — |
| A | RE20 | 52.4 | 27.1 |
| B | | 50.0 | 26.1 |
| A | RE40 | 60.6 | 33.6 |
| B | | 46.5 | 32.3 |
| A | RE60 | 68.8 | 39.0 |
| B | | 66.0 | 40.4 |

Table 5 illustrates mechanical properties for samples of different combinations of 1070 and 3104. The sample sizes for the mechanical testing were about 5.5 mm×6.5 mm. Table 6 provides buckle pressure and burst pressure for samples of different combinations of 1070 and 3104.

TABLE 5

| Alloy | Thickness | Yield Strength (ksi) | Tensile Strength (ksi) | % Elongation (2") |
|---|---|---|---|---|
| 1070 | 5.5 mm | 2.8 | 10.6 | 56.4 |
| | 6.5 mm | 2.1 | 10.4 | 58.6 |
| ReAl 20 | 5.5 mm | 4.0 | 14.2 | 40.2 |
| | 6.5 mm | 3.9 | 14.2 | 41.2 |
| ReAl 40 | 5.5 mm | 5.8 | 17.0 | 33.9 |
| | 6.5 mm | 5.9 | 17.0 | 34.8 |
| ReAl 60 | 5.5 mm | 7.7 | 20.5 | 30.5 |
| | 6.5 mm | 7.9 | 20.4 | 30.0 |

TABLE 6

| Pressure measurement (bar) | | Avg. | Min. (B) | Max. (B) |
|---|---|---|---|---|
| 1070 | 1st Def. | 19 | 18 | 19 |
| Re20 | | 23 | 22 | 25 |
| Re40 | | 27 | 26 | 28 |
| Re60 | | 30 | 27 | 33 |
| 1070 | Burst | 23 | 23 | 24 |
| Re20 | | 28 | 28 | 29 |
| Re40 | | 30 | 29 | 31 |
| Re60 | | 32 | 31 | 33 |

Table 7 illustrates composition ranges of an aluminum alloy, where at least about 40 wt. % of aluminum alloy 1070, and wherein at most about 60 wt. % of a second material, aluminum alloy 3105, is used in an aluminum alloy composition. At least one of the aluminum alloy materials can be recycled material. Table 7A illustrates compositions of an aluminum alloy at different percentages. All values listed in the table are approximate values and the composition will be achieved if the amount of a component is +/−about 10% of the listed amount.

TABLE 7

| Element | Amount (wt. %) |
|---|---|
| Si | 0.11-0.38 |
| Fe | 0.24-0.50 |
| Cu | 0-0.19 |
| Mn | 0.04-0.19 |
| Mg | 0.03-0.13 |
| Zn | 0.05-0.25 |
| Cr | 0.03-0.13 |
| Ti | 0-0.03 |
| Al | 98.22-99.45 (or balance) |
| Impurities | 0-0.05 (each) |

TABLE 7A

| Element | 3105 10% | 3105 20% | 3105 30% | 3105 40% | 3105 50% | 3105 60% |
|---|---|---|---|---|---|---|
| Si | 0.11 | 0.16 | 0.22 | 0.27 | 0.33 | 0.38 |
| Fe | 0.24 | 0.29 | 0.34 | 0.39 | 0.44 | 0.50 |
| Cu | 0.04 | 0.07 | 0.10 | 0.13 | 0.16 | 0.19 |
| Mn | 0.04 | 0.07 | 0.10 | 0.13 | 0.16 | 0.19 |
| Mg | 0.03 | 0.05 | 0.07 | 0.09 | 0.11 | 0.13 |
| Zn | 0.05 | 0.09 | 0.13 | 0.17 | 0.21 | 0.25 |
| Cr | 0.03 | 0.05 | 0.07 | 0.09 | 0.11 | 0.13 |
| Ti | 0.01 | 0.01 | 0.01 | 0.01 | 0.01 | 0.01 |
| Al (balance) | 99.45 | 99.21 | 98.96 | 98.72 | 98.47 | 98.22 |
| Impurities (each) | 0.05 | 0.05 | 0.05 | 0.05 | 0.05 | 0.05 |

If titanium boride is added to the composition comprising 1070 and 3105, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 8 illustrates composition ranges of an aluminum alloy, where at least about 40 wt. % of aluminum alloy 1070, and wherein at most about 60 wt. % of a second material, 3004, is used in an aluminum alloy composition. At least one of the materials can be recycled material. Table 8A illustrates compositions of an aluminum alloy at different percentages. All values listed in the table are approximate values and the composition will be achieved if the amount of a component is +/−about 10% of the listed amount.

TABLE 8

| Element | Amount (wt. %) |
|---|---|
| Si | 0.08-0.20 |
| Fe | 0.23-0.44 |
| Cu | 0-0.19 |
| Mn | 0.04-0.19 |
| Mg | 0.05-0.25 |
| Zn | 0.03-0.13 |
| Cr | 0.02-0.07 |
| Ti | 0-0.03 |
| Al | 98.52-99.50 (or balance) |
| Impurities | 0-0.05 (each) |

TABLE 8A

| Element | 3004 10% | 3004 20% | 3004 30% | 3004 40% | 3004 50% | 3004 60% |
|---|---|---|---|---|---|---|
| Si | 0.08 | 0.10 | 0.13 | 0.15 | 0.18 | 0.2 |
| Fe | 0.23 | 0.27 | 0.31 | 0.35 | 0.39 | 0.44 |
| Cu | 0.04 | 0.07 | 0.10 | 0.13 | 0.16 | 0.19 |
| Mn | 0.04 | 0.07 | 0.10 | 0.13 | 0.16 | 0.19 |
| Mg | 0.05 | 0.09 | 0.13 | 0.17 | 0.21 | 0.25 |
| Zn | 0.03 | 0.05 | 0.07 | 0.09 | 0.11 | 0.13 |
| Cr | 0.02 | 0.03 | 0.04 | 0.05 | 0.06 | 0.07 |
| Ti | 0.01 | 0.01 | 0.01 | 0.01 | 0.01 | 0.01 |
| Al (balance) | 99.50 | 99.31 | 99.11 | 98.92 | 98.72 | 98.52 |
| Impurities (each) | 0.05 | 0.05 | 0.05 | 0.05 | 0.05 | 0.05 |

If titanium boride is added to the composition comprising 1070 and 3004, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 9 illustrates composition ranges of an aluminum alloy, where at least about 40 wt. % of aluminum alloy 1070, and wherein at most about 60 wt. % of a second material, aluminum alloy 3003, is used in an aluminum alloy composition. At least one aluminum alloy can be recycled material. Table 9A illustrates compositions of an aluminum alloy at different percentages. All values listed in the table are approximate values and the composition will be achieved if the amount of a component is +/−about 10% of the listed amount.

TABLE 9

| Element | Amount (wt. %) |
|---|---|
| Si | 0.11-0.38 |
| Fe | 0.24-0.5 |
| Cu | 0-0.13 |
| Mn | 0.16-0.91 |
| Mg | 0.02-0.04 |
| Zn | 0.02-0.07 |
| Cr | 0.02-0.04 |
| Ti | 0.02-0.04 |
| Al | 97.89-99.38 (or balance) |
| Impurities | 0-0.05 (each) |

TABLE 9A

| Element | 3003 10% | 3003 20% | 3003 30% | 3003 40% | 3003 50% | 3003 60% |
|---|---|---|---|---|---|---|
| Si | 0.11 | 0.16 | 0.22 | 0.27 | 0.33 | 0.38 |
| Fe | 0.24 | 0.29 | 0.34 | 0.39 | 0.44 | 0.50 |
| Cu | 0.03 | 0.05 | 0.07 | 0.09 | 0.11 | 0.13 |
| Mn | 0.16 | 0.31 | 0.46 | 0.61 | 0.76 | 0.91 |
| Mg | 0.02 | 0.02 | 0.03 | 0.03 | 0.03 | 0.04 |
| Zn | 0.02 | 0.03 | 0.04 | 0.05 | 0.06 | 0.07 |
| Cr | 0.02 | 0.02 | 0.03 | 0.03 | 0.03 | 0.04 |
| Ti | 0.02 | 0.02 | 0.03 | 0.03 | 0.03 | 0.04 |
| Al | 99.38 | 99.10 | 98.78 | 98.50 | 98.21 | 97.89 |
| Impurities (each) | 0.05 | 0.05 | 0.05 | 0.05 | 0.05 | 0.05 |

If titanium boride is added to the composition comprising 1070 and 3003, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below.

Table 10 illustrates composition ranges of an aluminum alloy, where at least about 40 wt. % of aluminum alloy 1070, and wherein at most about 60 wt. % of a second material, aluminum alloy 3103, is used in an aluminum alloy composition. At least one of the aluminum alloy materials can be recycled material. Table 10A illustrates compositions of an aluminum alloy at different percentages. All values listed in the table are approximate values and the composition will be achieved if the amount of a component is +/−about 10% of the listed amount.

TABLE 10

| Element | Amount (wt. %) |
|---|---|
| Si | 0.08-0.20 |
| Fe | 0.23-0.44 |
| Cu | 0-0.19 |
| Mn | 0.04-0.19 |
| Mg | 0.05-0.25 |
| Zn | 0.03-0.13 |
| Cr | 0.02-0.07 |
| Ti | 0-0.03 |
| Al | 98.32-99.5 (or balance) |
| Impurities | 0-0.05 (each) |

TABLE 10A

| Element | 3103 10% | 3103 20% | 3103 30% | 3103 40% | 3103 50% | 3103 60% |
|---|---|---|---|---|---|---|
| Si | 0.08 | 0.10 | 0.13 | 0.15 | 0.18 | 0.20 |
| Fe | 0.23 | 0.27 | 0.31 | 0.35 | 0.39 | 0.44 |
| Cu | 0.04 | 0.07 | 0.10 | 0.13 | 0.16 | 0.19 |
| Mn | 0.04 | 0.07 | 0.10 | 0.13 | 0.16 | 0.19 |
| Mg | 0.05 | 0.09 | 0.13 | 0.17 | 0.21 | 0.25 |
| Zn | 0.03 | 0.05 | 0.07 | 0.09 | 0.11 | 0.13 |
| Cr | 0.02 | 0.03 | 0.04 | 0.05 | 0.06 | 0.07 |
| Ti | 0.01 | 0.01 | 0.01 | 0.01 | 0.01 | 0.01 |
| Al | 99.50 | 99.31 | 99.11 | 98.92 | 98.72 | 98.52 |
| Impurities (each) | 0.05 | 0.05 | 0.05 | 0.05 | 0.05 | 0.05 |

If titanium boride is added to the composition comprising 1070 and 3103, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below.

1050 in Combination

The tables below illustrate composition ranges of an aluminum alloy, where at least about 40 wt. % of aluminum alloy 1050, and wherein at most about 60 wt. % of a second material is used in an aluminum alloy composition. At least one material can be recycled material, or both materials can be pure or unrecycled. Impurities can also be present in the alloy composition. Impurities can include insoluble elements such as metallic elements or trace elements not specified in a registration for the alloying materials. The total amount of impurities should not exceed 0.15 wt. %. The amount of impurities in the composition can affect the maximum amount of aluminum in the composition, which can be the balance of the composition Table 11 illustrates composition ranges of an aluminum alloy, where at least about 40 wt. % of aluminum alloy 1050, and wherein at most about 60 wt. % of a second material, aluminum alloy 3104, is used in an aluminum alloy composition. At least one material can be recycled material. Table 11A illustrates specific compositions of an aluminum alloy at different percentages. Impurities can also be present in the alloy composition. All values listed in the table are approximate values and the composition will be achieved if the amount of a component is +/−about 10% of the listed amount.

TABLE 11

| Element | Amount (wt. %) |
|---|---|
| Si | 0.26-0.28 |
| Fe | 0.41-0.46 |
| Cu | 0-0.14 |
| Mn | 0.15-0.62 |
| Mg | 0.17-0.74 |
| Zn | 0.06-0.08 |
| Cr | 0.02-0.03 |
| Ti | 0-0.03 |
| Al | 97.63-98.83 (or balance) |
| Impurities | 0-0.05 (each) |

TABLE 11A

| Element | 3104 10% | 3104 20% | 3104 30% | 3104 40% | 3104 50% | 3104 60% |
|---|---|---|---|---|---|---|
| Si | 0.26 | 0.26 | 0.27 | 0.27 | 0.28 | 0.28 |
| Fe | 0.41 | 0.42 | 0.43 | 0.44 | 0.45 | 0.46 |
| Cu | 0.07 | 0.08 | 0.1 | 0.11 | 0.13 | 0.14 |
| Mn | 0.15 | 0.24 | 0.34 | 0.43 | 0.53 | 0.62 |
| Mg | 0.17 | 0.28 | 0.4 | 0.51 | 0.63 | 0.74 |
| Zn | 0.06 | 0.06 | 0.07 | 0.07 | 0.08 | 0.08 |
| Cr | 0.02 | 0.02 | 0.02 | 0.02 | 0.02 | 0.03 |
| Ti | 0.03 | 0.03 | 0.03 | 0.03 | 0.02 | 0.02 |
| Al | 98.83 | 98.61 | 98.34 | 98.12 | 97.86 | 97.63 |
| Impurities (each) | 0.05 | 0.05 | 0.05 | 0.05 | 0.05 | 0.05 |

If titanium boride is added to the composition comprising 1050 and 3104, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 12 illustrates composition ranges of an aluminum alloy, where at least about 40 wt. % of aluminum alloy 1050, and wherein at most about 60 wt. % of a second material, aluminum alloy 3105, is used in an aluminum alloy composition. At least one aluminum alloy material can be recycled material. Table 12A illustrates compositions of an aluminum alloy at different percentages. All values listed in the table are approximate values and the composition will be achieved if the amount of a component is +/−about 10% of the listed amount.

TABLE 12

| Element | Amount (wt. %) |
|---|---|
| Si | 0.29-0.46 |
| Fe | 0.43-0.58 |
| Cu | 0-0.2 |
| Mn | 0.08-0.2 |
| Mg | 0.07-0.14 |
| Zn | 0.09-0.26 |
| Cr | 0.03-0.13 |
| Ti | 0-0.03 |
| Al | 98.01-98.90 (or balance) |
| Impurities | 0-0.05 (each) |

TABLE 12A

| Element | 3015 10% | 3105 20% | 3105 30% | 3105 40% | 3105 50% | 3105 60% |
|---|---|---|---|---|---|---|
| Si | 0.29 | 0.32 | 0.36 | 0.39 | 0.43 | 0.46 |
| Fe | 0.43 | 0.46 | 0.49 | 0.52 | 0.55 | 0.58 |
| Cu | 0.08 | 0.1 | 0.13 | 0.15 | 0.18 | 0.2 |
| Mn | 0.08 | 0.1 | 0.13 | 0.15 | 0.18 | 0.2 |
| Mg | 0.07 | 0.08 | 0.1 | 0.11 | 0.13 | 0.14 |
| Zn | 0.09 | 0.12 | 0.16 | 0.19 | 0.23 | 0.26 |
| Cr | 0.03 | 0.05 | 0.07 | 0.09 | 0.11 | 0.13 |
| Ti | 0.03 | 0.03 | 0.03 | 0.03 | 0.02 | 0.02 |
| Al | 98.9 | 98.74 | 98.53 | 98.37 | 98.17 | 98.01 |
| Impurities (each) | 0.05 | 0.05 | 0.05 | 0.05 | 0.05 | 0.05 |

If titanium boride is added to the composition comprising 1050 and 3105, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below.

Table 13 illustrates composition ranges of an aluminum alloy, where at least about 40 wt. % of aluminum alloy 1050, and wherein at most about 60 wt. % of a second material, aluminum alloy 3004, is used in an aluminum alloy composition. At least one aluminum alloy material can be recycled material. Table 13A illustrates compositions of the aluminum alloy at different percentages. All values listed in the table are approximate values and the composition will be achieved if the amount of a component is +/−about 10% of the listed amount.

TABLE 13

| Element | Amount (wt. %) |
|---|---|
| Si | 0.26-0.28 |
| Fe | 0.42-0.52 |
| Cu | 0-0.2 |
| Mn | 0.08-0.2 |
| Mg | 0.09-0.26 |
| Zn | 0.07-0.14 |
| Cr | 0.02-0.07 |
| Ti | 0-0.03 |
| Al | 98.31-98.95 (or balance) |
| Impurities | 0-0.05 (each) |

TABLE 13A

| Element | 3004 10% | 3004 20% | 3004 30% | 3004 40% | 3004 50% | 3004 60% |
|---|---|---|---|---|---|---|
| Si | 0.26 | 0.26 | 0.27 | 0.27 | 0.28 | 0.28 |
| Fe | 0.42 | 0.44 | 0.46 | 0.48 | 0.50 | 0.52 |
| Cu | 0.08 | 0.10 | 0.13 | 0.15 | 0.18 | 0.20 |
| Mn | 0.08 | 0.10 | 0.13 | 0.15 | 0.18 | 0.20 |
| Mg | 0.09 | 0.12 | 0.16 | 0.19 | 0.23 | 0.26 |
| Zn | 0.07 | 0.08 | 0.10 | 0.11 | 0.13 | 0.14 |
| Cr | 0.02 | 0.03 | 0.04 | 0.05 | 0.06 | 0.07 |
| Ti | 0.03 | 0.03 | 0.03 | 0.03 | 0.02 | 0.02 |
| Al | 98.95 | 98.84 | 98.68 | 98.57 | 98.42 | 98.31 |
| Impurities (each) | 0.05 | 0.05 | 0.05 | 0.05 | 0.05 | 0.05 |

If titanium boride is added to the composition comprising 1050 and 3004, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 14 illustrates composition ranges of an aluminum alloy, where at least about 40 wt. % of aluminum alloy 1050, and wherein at most about 60 wt. % of a second material, aluminum alloy 3103, is used in an aluminum alloy composition. At least one aluminum alloy material can be recycled material. Table 14A illustrates compositions of an aluminum alloy at different percentages. All values listed in the table are approximate values and the composition will be achieved if the amount of a component is +/−about 10% of the listed amount.

TABLE 14

| Element | Amount (wt. %) |
|---|---|
| Si | 0.28-0.40 |
| Fe | 0.43-0.58 |
| Cu | 0-0.08 |
| Mn | 0.20-0.92 |

TABLE 14-continued

| Element | Amount (wt. %) |
|---|---|
| Mg | 0.08-0.2 |
| Zn | 0.07-0.14 |
| Cr | 0.02-0.07 |
| Ti | 0.04-0.05 |
| Al | 97.56-98.82 (or balance) |
| Impurities | 0-0.05 (each) |

TABLE 14A

| Element | 3103 10% | 3103 20% | 3103 30% | 3103 40% | 3103 50% | 3103 60% |
|---|---|---|---|---|---|---|
| Si | 0.28 | 0.30 | 0.33 | 0.35 | 0.38 | 0.40 |
| Fe | 0.43 | 0.46 | 0.49 | 0.52 | 0.55 | 0.58 |
| Cu | 0.06 | 0.06 | 0.07 | 0.07 | 0.08 | 0.08 |
| Mn | 0.20 | 0.34 | 0.49 | 0.63 | 0.78 | 0.92 |
| Mg | 0.08 | 0.10 | 0.13 | 0.15 | 0.18 | 0.20 |
| Zn | 0.07 | 0.08 | 0.10 | 0.11 | 0.13 | 0.14 |
| Cr | 0.02 | 0.03 | 0.04 | 0.05 | 0.06 | 0.07 |
| Ti | 0.04 | 0.04 | 0.04 | 0.04 | 0.04 | 0.05 |
| Al (balance) | 98.82 | 98.59 | 98.31 | 98.08 | 97.80 | 97.56 |
| Impurities (each) | 0.05 | 0.05 | 0.05 | 0.05 | 0.05 | 0.05 |

If titanium boride is added to the composition comprising 1050 and 3103, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 15 illustrates composition ranges of an aluminum alloy, where at least about 30 wt. % of aluminum alloy 1050, and wherein at most about 70 wt. % of a second material, aluminum alloy 3003, is used in an aluminum alloy composition. At least one aluminum alloy material can be recycled material. Table 15A illustrates compositions of the aluminum alloy at different percentages. All values listed in the table are approximate values and the composition will be achieved if the amount of a component is +/−about 10% of the listed amount.

TABLE 15

| Element | Amount (wt. %) |
|---|---|
| Si | 0.29-0.46 |
| Fe | 0.43-0.58 |
| Cu | 0-0.14 |
| Mn | 0.20-0.92 |
| Mg | 0-0.05 |
| Zn | 0.06-0.08 |
| Cr | 002-0.04 |
| Ti | 0.04-0.05 |
| Al | 97.68-98.84 (or balance) |
| Impurities | 0-0.05 (each) |

TABLE 15A

| Element | 3003 10% | 3003 20% | 3003 30% | 3003 40% | 3003 50% | 3003 60% |
|---|---|---|---|---|---|---|
| Si | 0.29 | 0.32 | 0.36 | 0.39 | 0.43 | 0.46 |
| Fe | 0.43 | 0.46 | 0.49 | 0.52 | 0.55 | 0.58 |
| Cu | 0.07 | 0.08 | 0.10 | 0.11 | 0.13 | 0.14 |
| Mn | 0.20 | 0.34 | 0.49 | 0.63 | 0.78 | 0.92 |
| Mg | 0.05 | 0.05 | 0.05 | 0.05 | 0.05 | 0.05 |

TABLE 15A-continued

| Element | 3003 10% | 3003 20% | 3003 30% | 3003 40% | 3003 50% | 3003 60% |
|---|---|---|---|---|---|---|
| Zn | 0.06 | 0.06 | 0.07 | 0.07 | 0.08 | 0.08 |
| Cr | 0.02 | 0.02 | 0.03 | 0.03 | 0.03 | 0.04 |
| Ti | 0.04 | 0.04 | 0.04 | 0.04 | 0.04 | 0.05 |
| Al | 98.84 | 98.63 | 98.37 | 98.16 | 97.91 | 97.68 |
| Impurities (each) | 0.05 | 0.05 | 0.05 | 0.05 | 0.05 | 0.05 |

If titanium boride is added to the composition comprising 1050 and 3003, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below.

P1020A in Combination

The tables below illustrate composition ranges of an aluminum alloy, where at least about 40 wt. % of aluminum alloy P1020, and wherein at most about 60 wt. % of a second material is used in an aluminum alloy composition. At least one material can be recycled material, or both materials can be pure or unrecycled. Impurities can also be present in the alloy composition. Impurities can include insoluble elements such as metallic elements or trace elements not specified in a registration for the alloying materials. The total amount of impurities should not exceed 0.15 wt. %. The amount of impurities in the composition can affect the maximum amount of aluminum in the composition, which can be the balance of the composition.

Table 16 illustrates specific compositions of an aluminum alloy at different percentages, where at least about 40 wt. % of aluminum alloy P1020A, and wherein at most about 60 wt. % of a second material, aluminum alloy 3104, is used in an aluminum alloy composition. Table 16A illustrates compositions of the aluminum alloy at different percentages. All values listed in the table are approximate values and the composition will be achieved if the amount of a component is +/−about 10% of the listed amount.

TABLE 16

| Element | Amount (wt. %) |
|---|---|
| Si | 0.26-0.28 |
| Fe | 0.41-0.46 |
| Cu | 0-0.14 |
| Mn | 0.15-0.62 |
| Mg | 0.17-0.74 |
| Zn | 0.06-0.08 |
| Cr | 0.02-0.02 |
| Ti | 0-0.03 |
| Al | 97.8-99.22 (or balance) |
| Impurities | 0-0.05 (each) |

TABLE 16A

| Element | 3104 10% | 3104 20% | 3104 30% | 3104 40% | 3104 50% | 3104 60% |
|---|---|---|---|---|---|---|
| Si | 0.26 | 0.26 | 0.27 | 0.27 | 0.28 | 0.28 |
| Fe | 0.41 | 0.42 | 0.43 | 0.44 | 0.45 | 0.46 |
| Cu | 0.07 | 0.08 | 0.10 | 0.11 | 0.13 | 0.14 |
| Mn | 0.15 | 0.24 | 0.34 | 0.43 | 0.53 | 0.62 |
| Mg | 0.17 | 0.28 | 0.40 | 0.51 | 0.63 | 0.74 |
| Zn | 0.06 | 0.06 | 0.07 | 0.07 | 0.08 | 0.08 |

TABLE 16A-continued

| Element | 3104 10% | 3104 20% | 3104 30% | 3104 40% | 3104 50% | 3104 60% |
|---|---|---|---|---|---|---|
| Cr | 0.02 | 0.02 | 0.02 | 0.02 | 0.02 | 0.03 |
| Ti | 0.03 | 0.03 | 0.03 | 0.03 | 0.02 | 0.02 |
| Al | 99.22 | 98.94 | 98.65 | 98.37 | 98.08 | 97.80 |
| Impurities (each) | 0.05 | 0.05 | 0.05 | 0.05 | 0.05 | 0.05 |

If titanium boride is added to the composition comprising P1020A and 3104, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 17 illustrates composition ranges of an aluminum alloy, where at least about 40 wt. % of aluminum alloy P1020A, and wherein at most about 60 wt. % of a second material, aluminum alloy 3105, is used in an aluminum alloy composition. At least one aluminum alloy material can be recycled material. Table 17A illustrates compositions of an aluminum alloy at different percentages. All values listed in the table are approximate values and the composition will be achieved if the amount of a component is +/−about 10% of the listed amount.

TABLE 17

| Element | Amount (wt. %) |
|---|---|
| Si | 0.29-0.46 |
| Fe | 0.43-0.58 |
| Cu | 0-0.20 |
| Mn | 0-0.20 |
| Mg | 0.07-0.14 |
| Zn | 0.09-0.26 |
| Cr | 0.03-0.13 |
| Ti | 0-0.03 |
| Al | 98.18-99.28 (or balance) |
| Impurities | 0-0.05 (each) |

TABLE 17A

| Element | 3105 10% | 3105 20% | 3105 30% | 3105 40% | 3105 50% | 3105 60% |
|---|---|---|---|---|---|---|
| Si | 0.29 | 0.32 | 0.36 | 0.39 | 0.43 | 0.46 |
| Fe | 0.43 | 0.46 | 0.49 | 0.52 | 0.55 | 0.58 |
| Cu | 0.08 | 0.10 | 0.13 | 0.15 | 0.18 | 0.20 |
| Mn | 0.08 | 0.10 | 0.13 | 0.15 | 0.18 | 0.20 |
| Mg | 0.07 | 0.08 | 0.10 | 0.11 | 0.13 | 0.14 |
| Zn | 0.09 | 0.12 | 0.16 | 0.19 | 0.23 | 0.26 |
| Cr | 0.03 | 0.05 | 0.07 | 0.09 | 0.11 | 0.13 |
| Ti | 0.03 | 0.03 | 0.03 | 0.03 | 0.02 | 0.02 |
| Al | 99.28 | 99.06 | 98.84 | 98.62 | 98.40 | 98.18 |
| Impurities (each) | 0.05 | 0.05 | 0.05 | 0.05 | 0.05 | 0.05 |

If titanium boride is added to the composition comprising P1020A and 3105, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 18 illustrates composition ranges of an aluminum alloy, where at least about 40 wt. % of aluminum alloy P1020A, and wherein at most about 60 wt. % of a second material, aluminum alloy 3004, is used in an aluminum alloy composition. At least one aluminum alloy material can be recycled material. Table 18A illustrates compositions of the aluminum alloy at different percentages. All values listed in the table are approximate values and the composition will be achieved if the amount of a component is +/−about 10% of the listed amount.

TABLE 18

| Element | Amount (wt. %) |
|---|---|
| Si | 0.29-0.28 |
| Fe | 0.42-0.52 |
| Cu | 0-0.20 |
| Mn | 0.08-0.20 |
| Mg | 0.03-0.26 |
| Zn | 0.07-0.14 |
| Cr | 0.02-0.07 |
| Ti | 0-0.03 |
| Al | 98.18-99.33 (or balance) |
| Impurities | 0-0.05 (each) |

TABLE 18A

| Element | 3004 10% | 3004 20% | 3004 30% | 3004 40% | 3004 50% | 3004 60% |
|---|---|---|---|---|---|---|
| Si | 0.26 | 0.26 | 0.27 | 0.27 | 0.28 | 0.28 |
| Fe | 0.42 | 0.44 | 0.46 | 0.48 | 0.50 | 0.52 |
| Cu | 0.08 | 0.10 | 0.13 | 0.15 | 0.18 | 0.20 |
| Mn | 0.08 | 0.10 | 0.13 | 0.15 | 0.18 | 0.20 |
| Mg | 0.09 | 0.12 | 0.16 | 0.19 | 0.23 | 0.26 |
| Zn | 0.07 | 0.08 | 0.10 | 0.11 | 0.13 | 0.14 |
| Cr | 0.02 | 0.03 | 0.04 | 0.05 | 0.06 | 0.07 |
| Ti | 0.03 | 0.03 | 0.03 | 0.03 | 0.02 | 0.02 |
| Al | 99.33 | 99.16 | 98.99 | 98.82 | 98.65 | 98.48 |
| Impurities (each) | 0.05 | 0.05 | 0.05 | 0.05 | 0.05 | 0.05 |

If titanium boride is added to the composition comprising P1020 and 3004, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 19 illustrates composition ranges of an aluminum alloy, where at least about 40 wt. % of aluminum alloy P1020A, and wherein at most about 60 wt. % of a second material, aluminum alloy 3103, is used in an aluminum alloy composition. At least one aluminum alloy material can be recycled material. Table 19A illustrates compositions of an aluminum alloy at different percentages. All values listed in the table are approximate values and the composition will be achieved if the amount of a component is +/−about 10% of the listed amount.

TABLE 19

| Element | Amount (wt. %) |
|---|---|
| Si | 0.28-0.40 |
| Fe | 0.43-0.58 |
| Cu | 0-0.08 |
| Mn | 0.20-0.92 |
| Mg | 0.08-0.20 |
| Zn | 0.07-0.14 |
| Cr | 0.02-0.07 |
| Ti | 0-0.05 |

TABLE 19-continued

| Element | Amount (wt. %) |
|---|---|
| Al | 97.73-99.21 (or balance) |
| Impurities | 0-0.05 (each) |

TABLE 19A

| Element | 3103 10% | 3103 20% | 3103 30% | 3103 40% | 3103 50% | 3103 60% |
|---|---|---|---|---|---|---|
| Si | 0.28 | 0.30 | 0.33 | 0.35 | 0.38 | 0.40 |
| Fe | 0.43 | 0.46 | 0.49 | 0.52 | 0.55 | 0.58 |
| Cu | 0.06 | 0.06 | 0.07 | 0.07 | 0.08 | 0.08 |
| Mn | 0.20 | 0.34 | 0.49 | 0.63 | 0.78 | 0.92 |
| Mg | 0.08 | 0.10 | 0.13 | 0.15 | 0.18 | 0.20 |
| Zn | 0.07 | 0.08 | 0.10 | 0.11 | 0.13 | 0.14 |
| Cr | 0.02 | 0.03 | 0.04 | 0.05 | 0.06 | 0.07 |
| Ti | 0.04 | 0.04 | 0.04 | 0.04 | 0.04 | 0.05 |
| Al | 99.21 | 98.91 | 98.62 | 98.32 | 98.03 | 97.73 |
| Impurities (each) | 0.05 | 0.05 | 0.05 | 0.05 | 0.05 | 0.05 |

If titanium boride is added to the composition comprising P1020A and 3103, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below. Table 20 illustrates composition ranges of an aluminum alloy, where at least about 40 wt. % of aluminum alloy P1020A, and wherein at most about 60 wt. % of a second material, aluminum alloy 3003, is used in an aluminum alloy composition. At least one aluminum alloy material can be recycled material. Table 20A illustrates compositions of the aluminum alloy at different percentages. All values listed in the table are approximate values and the composition will be achieved if the amount of a component is +/−about 10% of the listed amount.

TABLE 20

| Element | Amount (wt. %) |
|---|---|
| Si | 0.29-0.46 |
| Fe | 0.43-0.58 |
| Cu | 0-0.14 |
| Mn | 0.02-0.92 |
| Mg | 0-0.04 |
| Zn | 0.06-0.08 |
| Cr | 0.02-0.04 |
| Ti | 0-0.05 |
| Al | 97.85-99.23 (or balance) |
| Impurities | 0-0.05 (each) |

TABLE 20A

| Element | 3003 10% | 3003 20% | 3003 30% | 3003 40% | 3003 50% | 3003 60% |
|---|---|---|---|---|---|---|
| Si | 0.29 | 0.32 | 0.36 | 0.39 | 0.43 | 0.46 |
| Fe | 0.43 | 0.46 | 0.49 | 0.52 | 0.55 | 0.58 |
| Cu | 0.07 | 0.08 | 0.10 | 0.11 | 0.13 | 0.14 |
| Mn | 0.20 | 0.34 | 0.49 | 0.63 | 0.78 | 0.92 |
| Mg | 0.05 | 0.05 | 0.05 | 0.05 | 0.05 | 0.05 |
| Zn | 0.06 | 0.06 | 0.07 | 0.07 | 0.08 | 0.08 |
| Cr | 0.02 | 0.02 | 0.03 | 0.03 | 0.03 | 0.04 |
| Ti | 0.04 | 0.04 | 0.04 | 0.04 | 0.04 | 0.05 |

TABLE 20A-continued

| Element | 3003 10% | 3003 20% | 3003 30% | 3003 40% | 3003 50% | 3003 60% |
|---|---|---|---|---|---|---|
| Al | 99.23 | 98.95 | 98.68 | 98.40 | 98.13 | 97.85 |
| Impurities (each) | 0.05 | 0.05 | 0.05 | 0.05 | 0.05 | 0.05 |

If titanium boride is added to the composition comprising P1020A and 3003, then the amount of boron in the composition may not show a discernable increase. The amount of titanium in the composition may also not show a discernable increase, though there might be an increase by about 0.003-0.0055%. Even without a measurable effect on the composition, there can be an effect on the properties of the aluminum as discussed below.

Scrap from Fabrication Method

The compositions of the present invention can also be made using scrap from previously manufactured recycled aluminum (i.e. aluminum made using the present invention). The compositions of the materials using scrap of previously manufactured recycled aluminum will correlate with the compositions of the recycled aluminum scrap itself (i.e. the compositions set forth in Tables 2-3, and 7-20A). Additional prime aluminums, recycled aluminums and/or doping agents can be added to increase the amount of the composition such that the composition result in the one of the compositions set forth in Tables 2-3, 7-20A.

Compositions from Non-Recycled Materials

It is also understood that the compositions set forth in one of the Tables 2-3, 7-20A can be made using non-recycled materials. Thus, it is possible to make the composition set forth in Tables 3 and 3A by combining prime 1070 aluminum alloy and prime 3104 aluminum alloy without deviating from the invention.

In another aspect of the invention, the compositions of the invention can be made by combining a prime aluminum with individual alloying elements (i.e. Si, Mg, Fe, etc.).

Fabrication Method

FIG. 1 illustrates a method to fabricate an alloy from recycled aluminum 100. The recycled aluminum is processed to make slugs, which may be used in an impact extrusion process. Following the formation of the slugs, the slugs are processed in order to manufacture a container as provided in FIG. 2, which is discussed in greater detail below.

It is important to note that a slug is not a blank or sheet material as understood by one of at least ordinary skill in the art. More specifically, a slug is characterized by a cylindrical shape and formed by punching, whereas a sheet material or a blank is a flat material, typically rectangular.

One aspect of the present invention is a method to fabricate a new alloyed material by combining at least two alloy materials. In some embodiments, at least one material used to make the new alloy material can be a recycled aluminum alloy. In some embodiments, the new aluminum alloy composition may comprise a recycled scrap aluminum and a pure aluminum, which are melted and cast together in a process to form a novel recycled aluminum slug. In some embodiments, the new aluminum alloy composition can include at least one aluminum alloy, and a previously made aluminum alloy material. The aluminum alloy materials can be recycled. A doping agent can be included to adjust the composition. While the discussion below relates to a recycled aluminum material, one skilled in the art would also understand that it would be possible to combine two prime alloys to achieve the new alloy composition of the present invention. Similarly, one skilled in the art would also understand that one can use at least two recycled alloy materials to achieve the new alloy composition of the present invention.

Suitable recycled or prime aluminum materials may include many 3XXX alloys, especially 3005, 3104, 3105, 3103, 3013, and 3003. In smaller quantities, other alloys may be used to achieve the target chemistry. Alloy 3104 scrap can be sourced from beverage can plants. Alloy 3005 can be sourced from the automotive industry. The pure aluminum may include aluminum alloy P1020A, 1070 or 1050. A variety of scrap aluminum sources may be used as a source for the alloying element of the ReAl.

Melting

Scraps, aluminum alloy materials, prime aluminum, recycled scrap aluminum or combinations thereof are melted to facilitate mixing with the molten a second aluminum material (e.g. scrap, prime aluminum, recycled aluminum, or combinations thereof) 102 in accordance with the embodiments of the present invention for a particular alloying composition material (with reference to Tables 2-3, 7-20A, respectively). The aluminum materials can be bricks, cupped aluminum, scraps, or other shapes. In some embodiments, a remelter can be used to convert scrap aluminum, recycled or prime, into a solid ingot or sow. Remelters can use an indirect furnace. The recycled scrap aluminum may comprise aluminum alloy 3005, 3104, 3105, 3003, 3013 or 3103. When the furnace flame directly contacts the aluminum, a small amount of the surface aluminum oxidizes. If the surface area is large, such as compacted scrap bricks, the amount of the material oxidized and the melt loss can be higher than if the scrap bricks comprise a small surface area. Therefore, melting furnaces that utilize indirect methods to heat the materials are preferred to those that utilize direct flame impingement, though it is understood that direct flame impingement methods can be used.

More specifically, melting may occur in several types of furnaces. For example, a reverbatory furnace 112 may be used which is typical in a method to produce conventional impact extrusion slugs. The aluminum can be subjected to direct flame impingement. When melting compacted bricks of thin aluminum, the melt loss may likely be high. Therefore, a reverbatory furnace 112 is not a preferred in a method to produce ReAl slugs because of the high melt loss.

In some embodiments, an induction furnace 103 can also be used to melt the aluminum material(s).

In general, a furnace that utilizes an indirect method to heat the materials is preferred. Furnaces that utilize an indirect method to heat materials include, but are not limited to, side well furnaces and rotary furnaces. Thus, a side well furnace 110 may be used as the furnace. Side well furnaces contain the aluminum and gas burners transfer heat to the molten metal. The molten metal is then used to melt the scrap. Side well furnaces also have an impeller that circulates the molten bath through a side well. Scrap aluminum is fed into the side well at a rate such that the material largely melts before it circulates into the portion of the side well furnace where direct flame impingement is possible. The use of a side well furnace 110 is a preferred method for melting scrap metal for ReAl production.

Alternatively, a rotary furnace 104 may be used. A rotary furnace 104 is similar to a concrete mixer. The aluminum scrap tumbles in one corner of the rotating cylinder. The flame is directed away from this area and heats the refractory lining. The hot lining rotates and contacts the aluminum and transfers energy to the aluminum. A rotary furnace 104 is a preferred method for melting scrap for ReAl production. If a rotary furnace 104 or side well furnace 110 is used, the scrap exiting the rotary furnace 104 or side well furnace 110 may be melted and cast into ingots, sows or pigs 106 in an operation separate from the slug production. These ingots, sows or pigs may be melted in a second reverbatory furnace 108 with minimal melt loss because the surface area is relatively small.

If a direct flame impingement methods are preferred, a direct flame furnace can be used.

If elevated melt loss does occur during the melting process, dross must be removed from the bath.

After melting, the amount of the components of the composition are measured. If the amounts of the components are acceptable, then the process can continue to casting. If the amounts are not acceptable, then the composition can be adjusted by adding more of an aluminum alloy, or by adding at least one doping agent to adjust the composition. Suitable doping agents include Mg, Si, Fe, Cu, Mn, Zn, Cr, or Ti, and alloys containing these elements. The acceptable composition can correspond with the compositions set forth in the Tables above discussing different compositions.

Aluminum titanium boride or titanium boride (TiBor) can be added to the melt. TiBor can contain between about 4-6 wt. % of Ti, in some embodiments about 5 wt. % Ti, and between about 0.5-2 wt. % B, in some embodiments about 1 wt. % of B, if up to about 1.1 kg/metric tonne of TiBor is provided. In some embodiments, TiBor 114 can be added to the melted blend of aluminum alloys. In some embodiments, the melt with the TiBor can be degassed 115. TiBor can contain between about 4.5 wt. % and about 5.5 wt. % of Ti, and between about 0.7 wt. % and about 1.3 wt. % of B. Other materials can be included in the TiBor in an amount not to exceed about 0.7 wt. %. The TiBor can be added prior to the caster by a continuous feed of aluminum with a titanium boride dispersion. Alternatively, the TiBor can be added to the aluminum scrap alloy while it is in the furnace. The TiBor can refine the grain structure of the ReAl during processing. The TiBor concentration can be between about 0.5 kg/metric tonne and about 1.3 kg/metric tonne. In some embodiments, the TiBor concentration can be about 0.6 kg/metric tonne.

While not wishing to be bound by theory, it is believed that the TiBor assists the aluminum alloy in grain refinement during nucleation and solidification of the aluminum alloy. When metals solidify, the metal requires a surface on which to nucleate. Once the solid is nucleated, it will begin to grow. If there are very few nuclei in the melt, the resulting grains can be large because the grains grow unimpeded by their neighboring grains.

A melt with few nucleants can begin to solidify from the mold walls and impurities floating in the liquid metal, which results in a coarse as-cast grain structure lacking in ductility. Lower ductility can negatively affect the ability to roll (hot or cold) the aluminum alloy. Also, large as-cast grains result in large second phase particles, which also reduce metal ductility. As the metal solidifies, solute elements can segregate to intergranular liquid pools, which become rich in the solute to form these particles or intermetallic compounds.

An alloy of TiBor can be added to a melt in order to form fine $TiB_2$ particles in the melt. When the melt begins to solidify, these particles can act as nuclei on which solidification can begin and from which grains can grow. However, since there are many nucleation and growth sites, the grains can impinge on each other limiting their growth. The size of the intermetallic compounds can decrease and will be more finely distributed in the metal matrix. Thus, a main objective of grain refinement using TiBor can be to reduce the as-cast grain size.

The finer the "as-cast grain size" results in a smaller size of intermetallics. If the as-cast grain size is very fine (less than about 10 microns), and well dispersed then the grain growth during hot rolling and annealing can be reduced.

Casting

Following the melting process, the molten alloy is cast. In the casting process, molten alloy is solidified into a continuous slab of any suitable dimension using one of several casting techniques. In some embodiments of the present invention, the cast slabs are about 6-19 inches in width. In some embodiments, the width of the slab can be between about 8.5-9.5 inches wide. In some embodiments, the width of the cast can be between about 10-14 inches wide. The thickness of the slab can be between about 0.75-1.5 inches. In some embodiments, the thickness can be between about 0.85-1.3 inches. The casting speed should be in the range of between about 0.4 and about 1.1 metric tonnes/hour/inch of width. In some embodiments, the casting speed can be about 0.5-1.03 metric tonnes/hour/inch of width. In some embodiments, the casting speed can be between about 0.5-0.8 metric tonnes/hour/inch of width. In some embodiments, the casting speed can be about 0.62 metric tonnes/hour/inch of width.

Different casting methods may be used and may be chosen from a wheel belt caster 118, a Hazelett caster 116 and/or a block caster 122. When a wheel belt caster 118 is used, the molten aluminum can be held between a flanged wheel and a thick metal belt during solidification. The belt wraps around the wheel at about 180°. Both the wheel and the belt are chilled with water on the back side to optimize and control heat extraction. This wheel belt caster process is commonly used in the process to make 1070 and 1050 slugs. However, the thick steel belt is inflexible and unable to deflect and maintain contact with the slab that is shrinking due to solidification. The effect is magnified by the ReAl alloys because it solidifies over a larger temperature range (between about 480° C. and about 685° C.) than the purer alloys, 1050 and 1070 (typically between about 645° C. and about 655° C.).

Alternatively, a Hazelett caster 116 may be used. When a Hazelett caster 116 is used, the molten aluminum can be held between two flexible steel belts during solidification. Steel dam blocks can be chain mounted and form the sides of the mold. The parallel belts can slope slightly downward to allow gravity to feed molten aluminum into the system. High pressure water is sprayed on the back side of both belts to optimize and control heat extraction. This high-pressure water also deflects the belt to keep it in contact with the solidifying, contracting slab. This belt deflection enables the Hazelett caster 116 to produce a wide range of aluminum (and other) alloys. The Hazelett caster process is commonly used to produce architectural aluminum strip and may be used to produce impact extrusion slugs.

Alternatively, a block caster 122 can be used. When a block caster 122 is used, the molten aluminum is held between a series of chain mounted steel blocks during solidification and form the sides of the mold. The blocks are water cooled to optimize and control heat extraction.

A lubricating powder may be applied to the caster components that contact the slab. More specifically, a graphite or silica powder may be applied as necessary. Temperature control is important during and following the casting process. During casting, regardless of the casting process used, the cooling rate and temperature profile of the slab must be carefully controlled during solidification. The wheel belt caster 118 reduces the cooling water flow rate to achieve this. If the Hazelett caster 116 is used, the water flow for general control and gas flow over the slab may be used to closely modify the temperature. Ambient conditions, especially air flow must be controlled near the caster. This air flow control is especially critical when gas flow is used to modify the slab temperature.

The temperature of the slab at the exit of the caster must also be carefully controlled. In some embodiments, the exit temperature of the slab through the Hazelett caster 116 can be above about 520° C., however the maximum temperature of any part of the slab exiting the caster can be less than about 582° C. In some embodiments, the exit temperature of the slab can be between about 430° C. and about 490° C., which can depend on the composition of the aluminum alloy.

Rolling/Milling

Following casting, the thickness of the casting slab is reduced from about 0.75 inches to about 1.5 inches to a specified thickness of between about 0.15 inches to about 0.55 inches by hot rolling in a hot mill 124/126 and a cold rolling in a cold mill 130/132 to produce a rolled strip. Hot and cold rolling are required to achieve the proper thickness, as well as to achieve the desired physical metallurgy, such as grain structure, which results in the required mechanical properties of the slug. The relative thickness reduction taken in the hot mill 124/126 and the cold mill 130/132 significantly affects the metallurgical grain structure of the finished product, such as whether the grains are equiaxed and uniform in size. The thickness of the partially rolled strip at the hot mill 124/126 exit may vary. In some embodiments, the thickness of the partially rolled strip following hot rolling in the hot mill 124/126 is between about 0.23 inches and about 0.71 inches. In order to reach the specified thickness of the rolled strip, which is between about 0.15 inches and about 0.55 inches, the casted slab passes between two counter rotating rolls with a gap less than the incoming thickness while the casting slab is still at a high temperature of between about 350° C. to about 550° C. In some embodiments, the temperature can be between about 420° C. and about 550° C. In some embodiments, the temperature can be between about 520° C. and about 550° C. In some embodiments, the temperature of the strip exiting the hot rolling can be between about 350° C. and about 430° C. Rolling mills have two commonly used configurations. For example, two or four-high mills can be used for hot rolling or cold rolling. Other numbered mills can also be used. Furthermore, multiple mills can be used. The most common is a two-high mill that contains only two counter-rotating rolls that contact the slab/strip. In some embodiments, a cluster mill can be used. In some embodiments, two rolling mills are used to obtain the desired thickness. Optionally, an advanced design is a four-high mill in which the two-counter rotating rolls, the work rolls, are backed up by larger rolls. Optionally, additional hot mills 126 may be used.

During hot rolling in the hot mill 124/126, the alloy material may dynamically recrystallize and/or recover. This recrystallization and/or recovery is a self annealing process enabled by the heat in the casted slab. The temperatures at which dynamic recrystallization and/or recovery may occur varies with alloy content and may therefore differ for 1050/1070 and ReAl alloys. In most instances, the temperature for dynamic recrystallization and/or recovery is between about 350° C. to about 550° C. for ReAl material.

Following hot rolling in the hot mill 124/126, the partially rolled strip is immersed in a quench tank 128. The quench tank 128 contains a fluid, for example water, reduces the partially rolled strip temperature to near ambient (e.g. between about 25-50° C., in some embodiments, between about 45-50° C.). Following quenching, the partially rolled strip is subjected to a cold rolling in a cold mill 130/132. The partially rolled strip may be at less than about 95° C., in some embodiments about ambient temperature, and passes between two counter rotating rolls with a gap less than the incoming thickness. Normally two rolling mills may be used to obtain the desired thickness. However, a different number of rolling mills may be used. At ambient temperature, the rolled strip does not recrystallize. Cold rolling in the cold mill 130/132 can be two-high and four-high configurations. The four-high configuration may have better thickness control and is therefore strongly preferred during cold rolling when the final thickness is made. Optionally, additional cold milling rolls 132 may be used. Alternatively, at least one cold mills, typically one or two mills, can be used and the slabs may be recirculated to a cold mill 130/132 in order to achieve the specified thickness of the rolled strip. The operation temperature during cold rolling 130/132 can be between about 20° C. and about 95° C.

The relative amounts of thickness reduction taken in the hot mill 124/126 or cold mill 130/132 have a large effect on the recovery and recrystallization kinetics during annealing. The optimal ratio varies with alloy content, rolling mill capability and final strip thickness.

The internal friction in the rolled strip causes the temperature to rise during cold rolling in the cold mill 130/132 making the rolled strip warm. Therefore, the rolled strips may be subjected to ambient cooling 134 at between about 15° C. and about 50° C., preferably about 25° C., for between at least about 4 hours, in some embodiments between about 4 hours and about 8 hours following cold rolling in the cold mill 130/132. Alternatively, the cooled rolled strip can be held in storage to allow it to return to ambient temperature. In some embodiments, the rolled strips can be coiled for storage.

Annealing

Optionally, the rolled slabs can be annealed prior to forming the slugs. However, there are benefits to not annealing the rolled slabs prior to forming the slugs as the slug formation can benefit from having a more rigid structure during subsequent operations (i.e. punching).

Forming Slugs

The cooled rolled slabs are then punched 136. The cooled rolls can be uncoiled and fed into a die set mounted in a press. A die set punches or cuts circular slugs from the rolled slab, though it is understood that any shape of slug such as triangle, oval, circle, square, diamond, rectangle, pentagon, or the like may be used depending upon the shape of the die and/or the desired end product. The punching tool may be modified in order to control burrs. By way of example, the tool may be modified so that the die button chamfer is between about 0.039 inches by about 25° to about 0.050 inches by 29°. The thickness of the punched slugs is between about 0.15 inches and about 0.55 inches. The diameter or width of the punched slug can be between about 0.8 and about 3.5, in some embodiments between about 0.85 inches and about 3 inches, in some embodiments to facilitate forming the slug in an impact extrusion process into a container capable of receiving an end closure and holding pressure. The diameter of the slug can be chosen depending on the diameter of the final product. In some embodiments, the slug can be a cylinder. Furthermore, the thickness of the slug must be sufficient as this thickness will affect the height of the container. For example, if a thin slug, i.e. less than about 3 mm is used, then the height of the end product will not be sufficient as there is not enough material to provide the required height.

Annealing

Optionally, the punched slugs are heated to recrystallize the grains and ideally form a homogeneous, equiaxed grain structure. Annealing may occur by batch annealing 138 and/or continuous annealing 140. By way of example only, Table 21 provides the yield strength, tensile strength and elongation for samples containing 1070 and 3104 compared to samples of 1070.

TABLE 21

| Composition | Yield (kpsi) | Tensile (kpsi) | Elongation (kpsi) |
|---|---|---|---|
| 1070 | 2.8 | 10.6 | 56 |
| ReAl 20 | 4.0 | 14.2 | 40 |
| ReAl 40 | 5.8 | 17.1 | 34 |
| ReAl 60 | 7.7 | 20.5 | 31 |

When the punched slugs are batch annealed 138, the punched slugs may be loosely loaded into a holding device such as a wire mesh baskets. Several holding devices may be stacked together inside a furnace. The door to the furnace is closed and the slugs may be heated, to a target temperature and held for a specified time. The target temperature of the furnace is preferably between about 470° C. and about 600° C. for between about 5 and about 9 hours, though the annealing time and temperature have a strong interaction and are influenced by the alloy content of the slugs. In some embodiments, the temperature of the furnace can be between about 470° C. and about 550° C. The furnace may be turned off and the slugs allowed to slowly cool in the furnace. Because of the large mass of punched slugs in the furnace, there may be considerable inconsistency in the temperature of the slugs. The packed slugs on the outside of the pack reach a higher temperature faster. The central slugs heat more slowly and never reach the maximum temperature achieved by the peripheral slugs. Furthermore, air drying the slugs may allow for the formation of oxides. In order to prevent or decrease the formation of oxides, an inert gas may be circulated in the furnace while the furnace is at temperature and/or while it is cooled. Alternatively, the batch annealing 138 may occur in an inert atmosphere or under vacuum.

Figure 3:
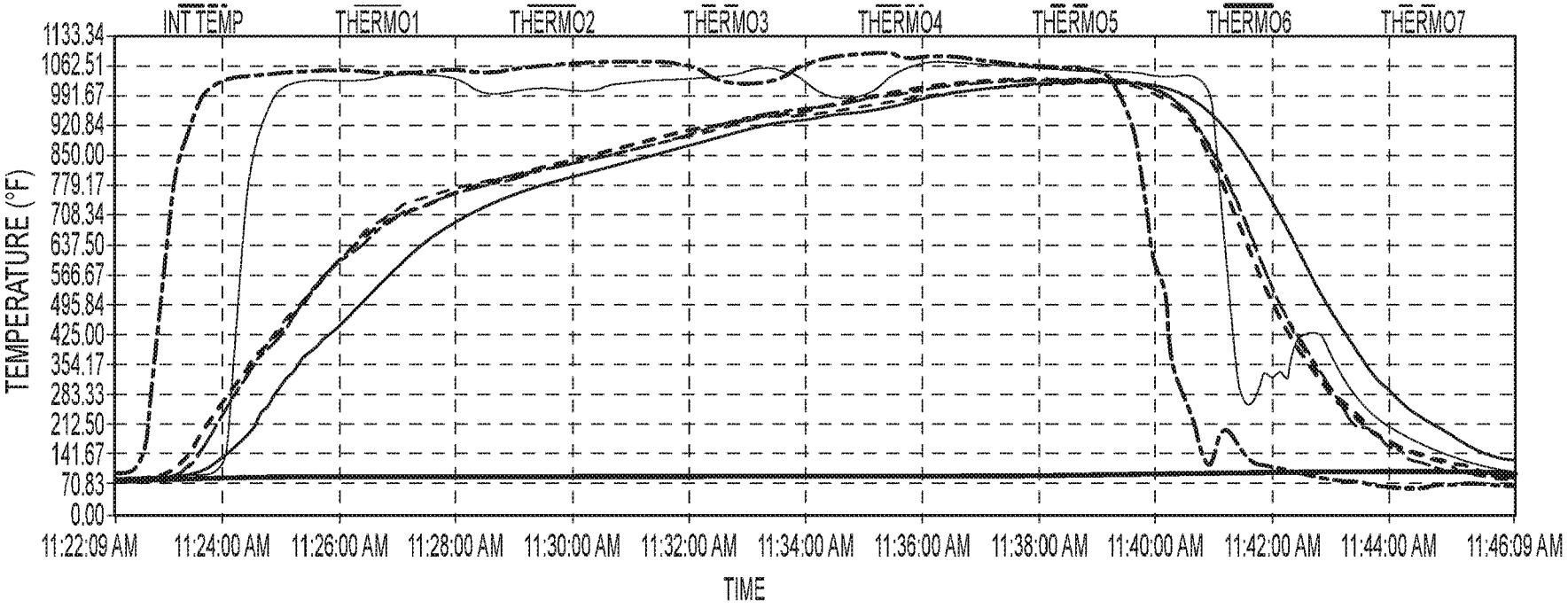
FIG. 3 illustrates a continuous anneal process.

Alternatively, the punched slugs may be continuously annealed 140. When the punched slugs are continuous annealed 140, the slugs are loosely distributed on a metal mesh belt on conveyed through a multi-zone furnace. The punched slugs are quickly heated to a peak metal temperature and then quickly cooled. The continuous annealing operation may be performed in air. The peak metal temperature is between about 450° C. to about 570° C. The peak metal temperature influences the final metallurgical characteristics. The peak temperature for optimal metallurgical characteristics is influenced by alloy content. Continuous annealing 140 is the preferred process for producing ReAl slugs. Continuous annealing 140 provides two benefits over batch annealing. First, the shorter time at elevated temperature reduces oxide formation on the surface of the slug. Aluminum oxides are a concern, however, magnesium oxides are a major concern due to its extreme abrasive nature. Increased magnesium oxide on the surface of the punched slugs may cause excessive scratching during the impact extrusion process. On extended runs these scratches are an unacceptable quality defect. Second, the precisely controlled and homogeneous thermal cycle including rapid heating, limited time at elevated temperature and rapid cooling of the continuous anneal 140 results in improved and more uniform metallurgical grain structure, such that the grains are equiaxed and uniform size. This in turn produces impact extruded containers of higher strength. Higher strength enables additional lightweight potential in the impact extruded containers. FIG. 3 illustrates temperature curves of a continuous annealing process.

Annealing of the slugs after punching is important for several reasons. First, any oxidation of the slugs produced during annealing can be decreased or removed during the finishing step (if performed). Second, annealing prepares the slugs for the impact extrusion process to manufacture a container, which is capable of receiving an end closure and holding an internal pressure. Thus, it is not only critical that annealing occur at the slug level, but that it also occur after punching.

Finishing

Optionally, the surface of the punched slugs may be finished by roughening the surface of the punched slugs. Different methods may be used to finish the punched slugs. In an embodiment, a tumbler process 142 may be used. A large quantity of the punched slugs are placed in a drum or other container and the drum is rotated and or vibrated. As slugs fall onto other slugs, denting may occur to one or both slugs. In vibration tumbling, the slugs are bounced around, ultimately impinging each other and roughening the surface. The purpose of roughening the surface is to increase the high surface area of the punched slug and create recesses to hold lubricant. The large faces of the punched slugs may also be finished along with the sheared surfaces.

In another embodiment, a shot blast finishing process 144 may be used. In the shot blast finishing process 144, a large number of slugs are placed in an enclosed drum and subjected to impingement by aluminum shot or other materials. The shot forms small depression on the surfaces of the slugs. The slugs are tumbled slightly so the aluminum shot contacts all surfaces of the slug.

Shot blasting 144 is the preferred process for producing ReAl slugs, and aggressive shot blasting has been shown to be the most effective at removing surface oxides from slugs. This removal of the surface oxides are especially critical for removing adherent magnesium oxides, which cause scratches in impact extruded containers if they are not removed from the slug.

The thickness of the slug is not reduced substantially with the finishing operation. Thus, the thickness of the slug is approximately the same as the thickness of the slug prior to finishing.

Container Manufacturing

Figure 2:
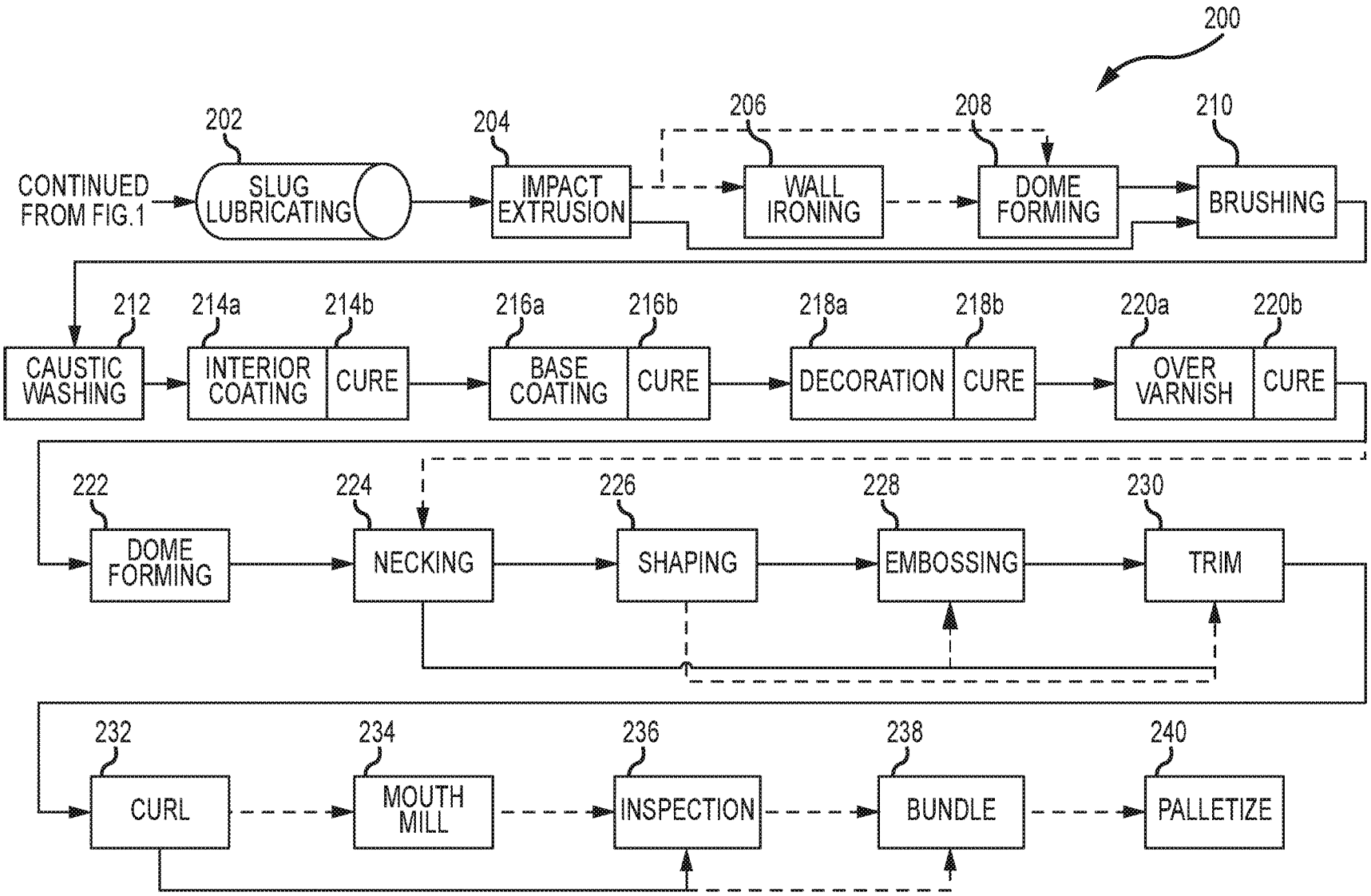
FIG. 2 illustrates an impact extrusion method for use with the recycled aluminum material.

FIG. 2 illustrates a method to manufacture a metallic container 200 using a slug manufactured from recycled scrap material as illustrated in FIG. 1.

A slug lubrication process 202 may be used wherein the slugs are tumbled with a powdered lubricant. Any suitable lubricant may be used, such as Sapilub GR8. Typically, about 100 g of lubricant is used per about 100 kg of slugs. Tumbling the lubricant with the slugs forces lubricant onto the slugs. If the slugs have been roughened, then tumbling the slugs with the lubricants force the lubricant into the depressions created during the finishing operation.

Impact Extrusion

Following the slug lubrication process 202, the lubricated slugs are subjected to an impact extrusion process 204. More specifically, the lubricated slugs are placed in a die of precise shape. In some embodiments, the die can be cemented carbide. The lubricated slug is impacted by a steel punch, also of precise shape, and the aluminum is extruded backwards away from the die. The tooling shapes dictate the wall thickness of the extruded tube portion of the container. Although this process is generally known as back extrusion, a forward extrusion process or combinations of back and forward extrusion could also be used as appreciated by one skilled in the art.

In some embodiments, the slug used in impact extrusion can be a disk. The diameter of the disk can be slightly smaller than the diameter of the end product, typically within about half a mm. The material for the container (less the closure) comes from the slug. In other words, there is a conservation of volume of the material between the slug and the container with minimal loss, and no gain in material.

The resulting product can be a container. A container can be a beverage container, an aerosol container, or any other type of container which can receive an end closure and is capable of retaining an internal pressure up to about 18 bar. A beverage container can have a height between about 1.8 inches and about 11 inches, in some embodiments about 3.9 inches and about 9.8 inches, a width/length (which can be different) or diameter between about 1.5 inches and about 4.3 inches, in some embodiments between about 1.9 inches and about 3.8 inches, and a thickness of the wall between about 0.003 inches and about 0.08 inches, in some embodiments between about 0.003 inches and about 0.04 inches. An aerosol container can have a height between about 2.3 inches and about 9.5 inches, a width/length (which can be different) or diameter between about 0.86 inches and about 3 inches.

It is important to note that the success of impact extrusion of a slug will be dependent upon the composition of the aluminum alloy and the method used to process the slug in the first instance. Not all alloys are conducive for impact extrusion. If an alloy contains too much iron or manganese, then it is susceptible to cracking during impact extrusion. Magnesium increases work hardening of the material, allowing the material to be lightweighted (i.e. thinned) and maintain a sufficient strength to meet some requirements, for example burst strength. Thus, if an alloy does not contain enough magnesium, then it may not be suitable for impact extrusion. Thus, the composition of the alloy is critical to the success of the impact extrusion. Furthermore, the process for manufacturing the material and the method for forming a slug can affect the success of the impact extrusion process. Thus, the casting process, the annealing process, the rolling process, etc. can affect whether a slug can be used in an impact extrusion process. Furthermore, impact extrusion is different from stamping. Stamping is a process whereby a thin sheet is formed by a die and punch by applying tensile and/or compressive stresses in the plane of the sheet. The resulting stresses may be in all dimensions; however, the through thickness strain is generally limited to between −40% engineering strain and +100% engineering strain. Thickness strains in impact extrusion can be −80% or more. Impact extrusion is also different from a process known as bending. Bending is a process whereby a radius or series of radii and imparted to a workpiece. Impact extrusion is also different from stretching, which is a process whereby tensile stresses are applied in the plane of a thin sheet, resulting in three dimensional strains. The thickness strain is generally limited to about −40% engineering strain. Impact extrusion is also different from a process known as drawing. Drawing is a process for forming thin metal products such as cups, cones, boxes, tubular shapes, and shell-like parts. A punch and die combination imparts compressive stresses to the outer portions of the thin blank, resulting in positive strain through the thickness. That is, the material in the outer portion of the blank become thicker. Most drawing operations start with a flat blank or a sheet of metal rather than a slug. Thus, a thin sheet material is the starting metal for a drawing process. A material is drawn by pressing or forcing a flat metal blank into a female die while stretching it to conform to a shape over a male die or punch.

Impact extrusion is different. In general, there are three different metallurgic forming processes for extrusion—forward extrusion, backward extrusion and a combination of backward and forward extrusion. Each extrusion process uses the term "slug" to describe the starting shape of the metal piece prior to the impact extrusion process. In the forward extrusion process, slugs can be short cylinders, small discs, thick washers, short lengths of tubing or small cups. The dimensions of the slug will affect the end dimensions and properties of the impact extruded product. Backward extrusion utilizes a solid slug in a closed bottom die so that a portion of the slug flows backward over the descending impact punch. Backward extrusion can be used to make containers, such as cans. Furthermore, in impact extrusion, a stress is applied to the workpiece parallel to the slug thickness. Other methods, for example bending, stamping and drawing, the stress is applied in the plane of the sheet, which is in a plane perpendicular to the thickness (with thickness being the smallest dimension).

Finally, it cannot be understated that the thickness of the slug will determine the height of the end product. Thus, a thin sheet material, i.e. a material less than about 0.079 inches in thickness would not be used in an impact extrusion process because the finished height of a container could not have a diameter of at least about 0.86 inches, at least about 2.3 inches in height, and at least about 0.003 inches in thickness, and thus not practical on useful for its intended purpose.

In some embodiments, the containers can be lightweighted during the impact extrusion process. Lightweighting will reduce the sidewall and bottom thicknesses and can be set during the impact extrusion process. Containers that have been lightweighted can have a sidewall thickness or a bottom thickness that is reduced by between about 5-40%, in some embodiments about 15%, compared to containers that have not been lightweighted.

Wall Ironing

Optionally, wall ironing 206 may be performed. The container may be passed between a punch and an ironing die with negative clearance. Wall ironing 206 thins the wall of the tube. The higher strength of ReAl alloy increases die deflection. Therefore, a smaller die is required to achieve the desired wall thickness. This optional process optimizes material distribution and keeps longer tubes straight.

Optionally, following the impact extrusion 204 or the wall ironing 206, the dome forming 208 on the bottom of the container may be performed. The full dome or a portion of the dome may be formed either at the end of the ironing stroke or in the trimmer.

After dome forming, the container is brushed 210 to remove surface imperfections. The rotating container is brushed by an oscillating metal or plastic, typically nylon, brush. Furthermore, brushing 210 may optionally be performed if the container has been subjected to wall ironing 206 and/or doming 208.

Optionally, the container can be washed 212 in a caustic solution to remove lubricants and other debris. The caustic wash 212 may comprise sodium hydroxide or alternatively potassium hydroxide or other similar chemicals known by those skilled in the art.

Coatings

The interior of the container can be coated, typically with a lance nozzle 214*a*. In one embodiment, the coating may be epoxy based. The coating may be applied using any suitable method including, but not limited to, spraying, painting, brushing, dipping, or the like. The coating can be thermally cured 214*b* at a temperature of between about 200 to about 250° C. for between about 5 to about 15 minutes.

Base coating 216*a* can be applied to the exterior of the container. The base coating may be a white or clear base coat or another color. The coating may be applied using any suitable method including, but not limited to, rolling, spraying, painting, brushing, dipping, or the like. The coating can be thermally cured 216*b* at a temperature of between about 110 to about 180° C. for between about 5 to about 15 minutes.

Decorative inks 218*a* may also be applied to the base coated container. The decorative ink may be applied using any suitable method including, but not limited to, spraying, painting, brushing, dipping, printing or the like. The decorative inks are thermally cured 218*b* at a temperature of between about 120 to about 180° C. for between about 5 to about 15 minutes.

Clear over varnish 220*a* is applied to the tube. The varnish may be applied using any suitable method including, but not limited to, spraying, painting, brushing, dipping, or the like. The varnish is thermally cured 220*b* at a temperature of between about 150 to about 200° C. for between about 5 to about 15 minutes.

Optionally, one or more of the coatings can be cured using any other suitable method known to those of skill in the art including using ultra violet light or electron beam radiation.

Dome Forming

Optionally, dome forming 222 may be formed or completed on the bottom of the container following coating. Dome forming 222 may be completed at this stage to ensure that the decoration extends to the standing surface of the container. An advantage of a two stage doming operation (before trimming 230 and before necking 224) is that the base coat extends to the standing surface of the finished can. However, this method may result in a higher rate of cracking of the internal coating. By decreasing the final dome depth before necking, this issue may be resolved.

Necking and Shaping

In a number of successive operations, the opening diameter of the container may be reduced by a process called necking 224. The number of reducing steps depends on the diameter reduction of the container and the shape of the neck. For ReAl alloy material, more necking steps are generally anticipated. Further, as the alloy content is altered, some modifications may be expected. For example, one modification requires that the necking center guides be changed in some instances. Larger center guides must be installed when running lightweight ReAl containers that are thinner near the top.

Figure 9A:
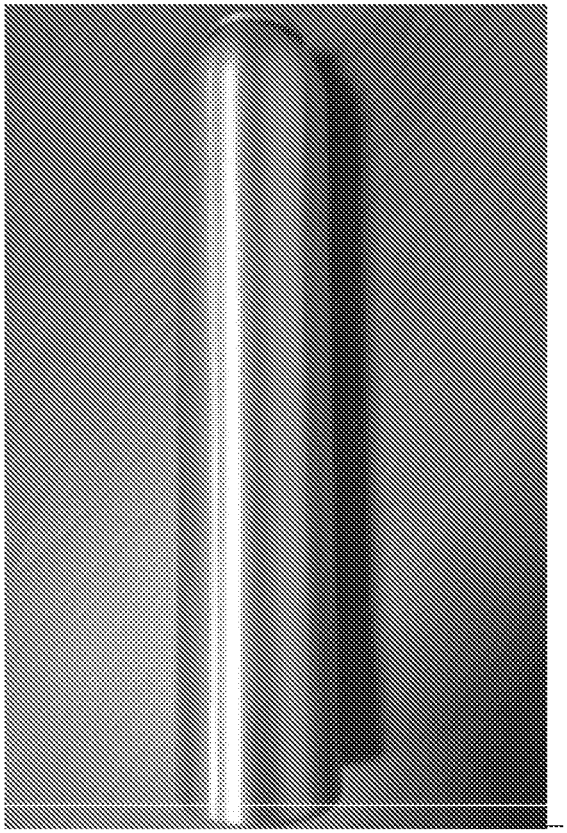
FIG. 9A illustrates a necked can where the material for the necked can is a 1070 alloy.
Figure 9B:
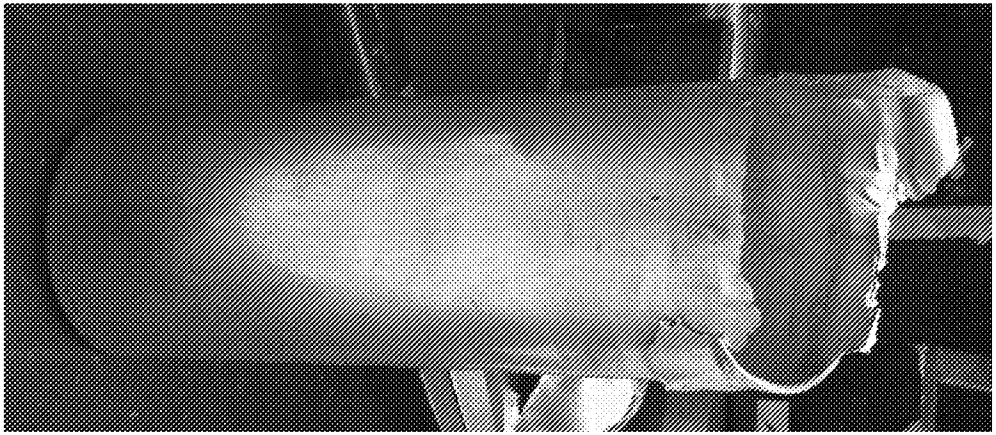
FIG. 9B illustrates a failed attempt to impact extrude a can where the material for was Re60 alloy.

The composition of the material used to make the container can affect the necking step. FIG. 9A illustrates a necked can for a 1070 alloy. FIG. 9B illustrates a failed attempt to impact extrude a Re60 alloy material to form a container. FIG. 9A necked well, while FIG. 9B did not impact extrude and was unable to be necked.

Optionally, the body of the container may be shaped 226. Shaping 226 may occur in various stages. The ReAl alloy may require additional shaping stages as compared to a traditional impact extrusion process. Similar to necking, smaller steps must be used when shaping ReAl containers.

Embossing

Optionally, tooling may move perpendicular to the container axis and emboss shapes in the container 228. The force applied during embossing 228 may be higher when using ReAl material than when traditional impact extrusion material is used as a result of higher as formed strength relative to P1020A, 1070 or 1050 alloys.

Trimming and Curling

Metal flow in necking 224 may create an uneven, work hardened edge. Therefore, the edge is trimmed 230 prior to curling. Due to anisotropy differences, ReAl thickens in a different profile during necking 224. Therefore, it is possible at high necking reductions and high alloy content that additional trimming operations may be required.

The open edge of the container is curled 232 over itself to create a mounting surface for an aerosol valve. For beverage bottles, the curl may accept an end closure. An end closure is used to close a container. The end closure can also include an area that can be opened to access the contents of the container and dispensing the fluid within the container. An aerosol valve assembly can be used as a closure for an aerosol container. Thus, the container can also include an end closure.

Optionally, a small amount of material may be machined from the top of the curl, which is known as the mouth mill 234. The mouth mill 234 may be required for mounting certain aerosol valves.

Inspections and Packaging

Inspections 236 may optionally be performed on the containers. Inspection steps may include camera testing, pressure testing, or other suitable testing.

The containers may be packaged. Optionally, the containers may be bundled 238. When bundling 238, the containers may be arranged in groups. The group size may vary and in some embodiments, the group size is typically about 100 containers. The size of the group may depend upon the diameter of the containers. The groups may be bundled using plastic strapping or other similar known processes. A special consideration for ReAl containers is that the strap tension must be controlled in order to prevent heel denting in high contact pressure areas of the bundle.

In an alternative packaging method, the containers are bulk palletized 240 similar to beverage containers.

End Product

One aspect of the invention is a container made from an aluminum alloy of the invention. The aluminum alloy is a combination of at least two aluminum alloys. In some embodiments, at least one of the aluminum alloys can be a recycled material. The compositions of the container are discussed in detail above, including in Tables 2-3, 7-20A. Methods for making the container are also discussed above in greater detail.

The container can be manufactured from a slug using an impact extrusion process. In some embodiments, the end product can be adapted to receive an end closure.

The container can be a beverage container, an aerosol container, or other type of closed vessel capable of receiving an end closure and retaining an internal pressure up to 18 bar. The container can have a height between about 2.3 inches and about 11 inches, a width/length (which can be different dimensions) or diameter between about 1.9 inches and about 3.74 inches, and a thickness of the wall between about 0.003 inches and about 0.16 inches. The beverage container can have a height between 1.8 inches and 9.8 inches, a width/length (which can be different dimensions) or diameter between about 1.5 inches and about 4.3 inches, and a thickness of the wall between about 0.0003 inches and about 0.04 inches. A beverage container can retain an internal pressure of up to about 7.6 bars after the container is closed. The aerosol container can have a height between about 2.3 inches and about 9.5 inches, a width/length (which can be different dimensions) or diameter between about 0.86 inches and about 3 inches, and a thickness of the wall between about 0.0003 inches and about 0.08 inches. An aerosol container can retain an internal pressure of up to about 18 bars after the container is closed.

The container can be finished by applying indicia or decorating the external surface of the container. Suitable printing methods include offset printing, laser printing or the like.

The interior of the bottle can be typically lance coated. In one embodiment, the coating may be epoxy based. The coating may be applied using any suitable method including, but not limited to, spraying, painting, brushing, dipping, or the like. The coating can be thermally cured at a temperature of between about 392° F. to about 482° F. for between about 5 to about 15 minutes.

Base coating can be generally applied to the exterior of the metallic bottle. The base coating may be a white or clear base coat. The coating can be applied using any suitable method including, but not limited to, spraying, painting, brushing, dipping, or the like. The coating can be thermally cured at a temperature of between about 230° F. to about 356° F. for between about 5 to about 15 minutes.

Decorative inks can also be applied to the base coated metallic bottle to produce brand names, logos, designs, product information, and/or other preferred indicia. The decorative ink may be applied using any suitable method including, but not limited to, spraying, painting, brushing, dipping, printing, or the like. Optionally, the metallic bottle can be decorated using lithography or other printing processes such as offset printing, dry offset printing, gravure printing, intaglio printing, screen printing, tampo printing, and inkjet printing. The decorative inks may be non-varnish inks or any other suitable ink, including thermochromatic inks. The decorative inks can be thermally cured at a temperature of between about 248° F. to about 356° F. for between about 5 to about 15 minutes.

A clear over varnish can be applied to the metallic bottle. The varnish may be applied using any suitable method including, but not limited to, spraying, painting, brushing, dipping, or the like. The varnish can be thermally cured at a temperature of between about 302° F. to about 392° F. for between about 5 to about 15 minutes. The coatings can protect the metal of the body portion from tooling contact, corrosion, and/or to protect the contents of the metallic bottle.

Optionally, one or more of the coatings can be cured using any other suitable method known to those of skill in the art including using ultra violet light or electron beam radiation.

Mechanical Properties

The containers and slugs made from the present invention have measurable properties. For example, the hardness (HB) of the material before annealing (step prior to impact extrusion) can be between about 40 and 70. The hardness of the material after annealing (step prior to impact extrusion) can be between about 19 and 41.

The yield strength of the material for a about 5.5-6.5 mm sample can be between about 3 ksi and 8 ksi. The tensile strength can be between about 14-21 ksi for samples that are between about 5.5-6.5 mm, and the percent elongation (2") can be between about 30-42.

Containers made from the present invention, whether lightweighted or not, can have a burst pressure greater than about 205 psig. In some embodiments, the burst pressure can be at least about 208 psig, at least about 240 psig, at least about 260 psig, at least about 270 psig, or at least about 313 psig. The minimum buckle pressure of containers of the present invention can be greater than about 160 psig. In some embodiments, the minimum buckle pressure can be at least about 160 psig, at least about 174 psig, at least about 180 psig, at least about 203 psig, at least about 217 psig, or at least about 261 psig. In some embodiments, the burst pressure or buckle pressure can be meet requirements set forth by a jurisdiction. By way of example, in some embodiments, the burst pressure or buckle pressure that a container must withstand can be set by a regulatory agency, such as the Department of Transportation in the United States, or the European Aerosol Foundation in Europe. The containers made by the present invention, whether lightweighted or not, can meet the requirements set forth by agencies. Furthermore, the buckle and burst pressures set by a jurisdiction can be based on the container rating, irrespective of the alloy.

EXAMPLES

Figure 4:
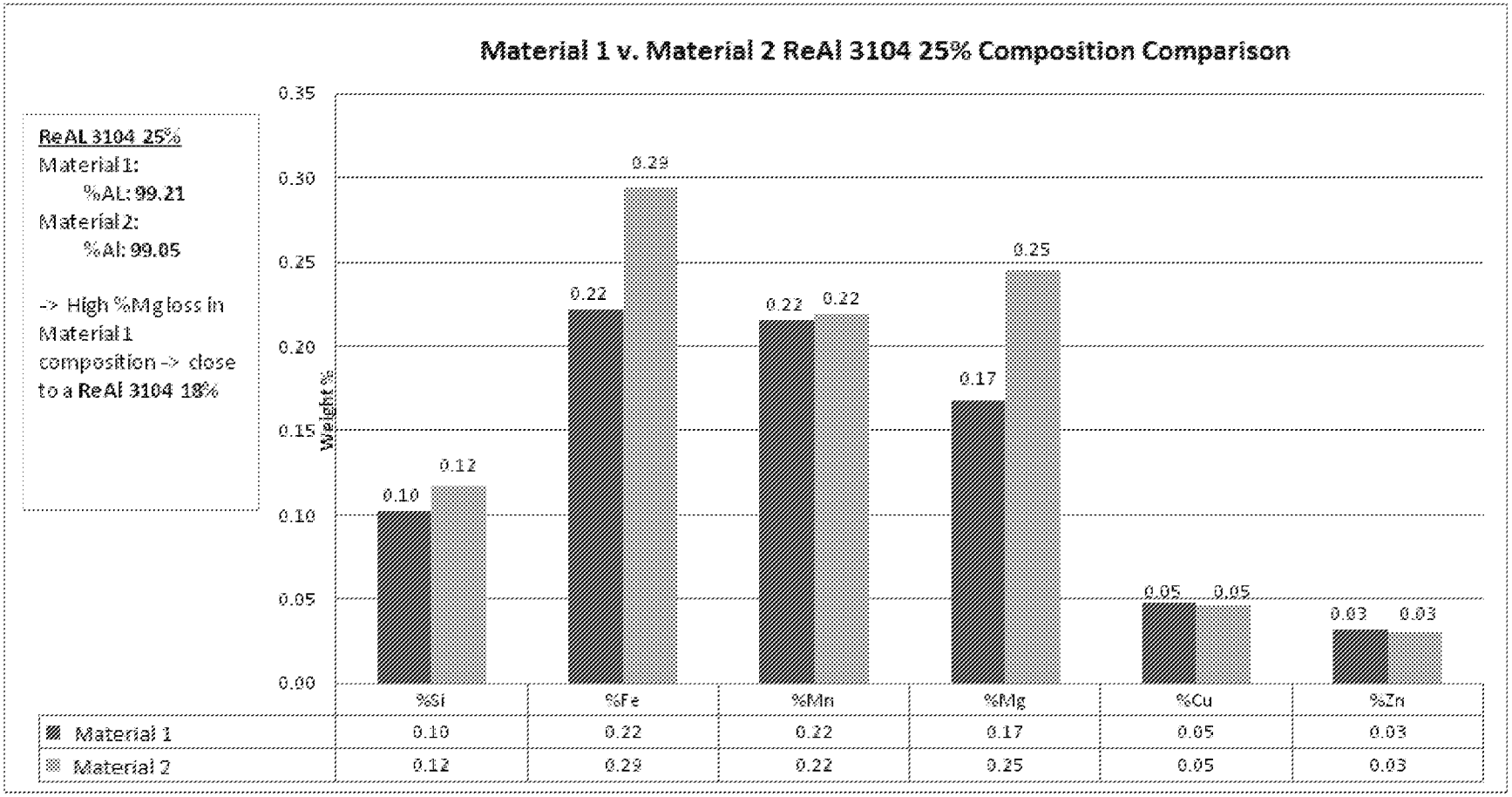
FIG. 4 illustrates a composition comparison of Material 1 and Material 2.

ReAl 3104 25% slugs were tested using two materials. Material 1 used remelt secondary ingots (RSI) produced from a briquetted cupper scrap. Material 1 samples were made at the Ball Advanced Aluminum Technology plant in Sherbrook Canada and Virginia. Material 2 melted briquette scrap. Material 2 samples were made at Copal, S.A.S. in France. FIG. 4 illustrates a comparison of Material 1 versus Material 2. Material 1 is much closer to about 18% 3104 cupper scrap content due to a significant loss of magnesium compared to the flood composition of Material 2. The processing type to melt the briquetted 3104 cupper scrap may have an influence on the final chemical composition of ReAl material.

The finish treatment for Material 1 samples was shot blasted. The finish for Material 2 samples was tumbled.

Table 22 illustrates the slug hardness for reference material 1050, Material 1 and Material 2 after finishing.

TABLE 22

| Alloy | 1050 (reference) | Material 1 | Material 2 |
|---|---|---|---|
| Hardness (HB) | 21.5 | 29 | 30.7 |

Due to the finishing, the values given in Table 22 may be higher than those measured after annealing process. Material 1 had a hardness that was approximately 35% greater than the reference material 1050, while Material 2 had a hardness that was approximately 43% greater than 1050.

The lubricant used was Sapilub GR8. Table 23 illustrates the lubrication parameters and lubrication weight for about 100 kg of slugs for a reference material 1050, Material 1 and Material 2. Note that the lubrication material for the reference material 1050 (GTTX) was different from the lubrication used for the slugs comprising Material 1 and Material 2 (GR8).

TABLE 23

| Lubrication parameters for 100 kg of slugs | 1050 (reference) | Material 1 | Material 2 |
|---|---|---|---|
| Lubricant weight (g) | 100 (GTTX) | 125 (GR8) | 110 (GR8) |
| Time of tumbler rotation (min) | 30 | 30 | 30 |

The lubrication process was performed on an offline tumbler for all slugs. The difference in lubricant ratio is due to the type of surface treatment (tumbled surface requires less lubricant than shot-blasted surface treatments).

The monobloc die used was a standard sintered carbide GJ15-1000HV. The punch head was a Bohler S600-680HV. The shape of the die was conical.

Tubes were brushed to highlight potential visual score marks and scratches. The internal varnish on the containers was PPG HOBA 7940-301/B (Epoxy phenolic). The setting of the application of the internal varnish Epoxy-phenolic PPG 7940 was standard. Temperature and time of curing was about 250° C. during about 8 min 30 s. There were no issues of porosity at following the internal varnish.

White base coat with gloss was applied to the containers. A printed design was also added to the containers.

Example 1

Example 1 utilized Material 1 and Material 2 with slugs that had a diameter of about 44.65 mm and a height of about 5.5 mm. The mass of the slug material was about 23.25 g. The final dimension of the container following processing, but prior to trimming, was about 150 mm+/−about 10 mm in height by about 45.14 mm in diameter. The thickness of the final container was about 0.28 mm+/−about 0.03 mm. The final mass of the container was about 23.22 g. A standard necking tooling was used.

Material 1 slugs tend to perform better in general with no score mark nor scratches emergence neither outside nor inside the tubes. Material 2 slugs are more sensitive to scratches and are more abrasive to the punch head surface. After using Material 2 slugs, the punch head needed to be changed because was worn. A larger punch may be required to meet the container parameters.

Example 2

Example 2 utilized Material 1 and Material 2 with slugs that had a diameter of about 44.65 mm and a height of about 5.0 mm. The mass of the slug material was about 21.14 g. The final dimensions of the container following processing, but prior to trimming was about was about 150 mm+/−about 10 mm in height by about 45.14 mm in diameter. The thickness of the final container was about 0.24 mm+/−about 0.03 mm. The final mass of the container was about 20.65 g. A larger diameter pilot was used. The diameter of the pilot was about 0.1 mm.

Figure 5:
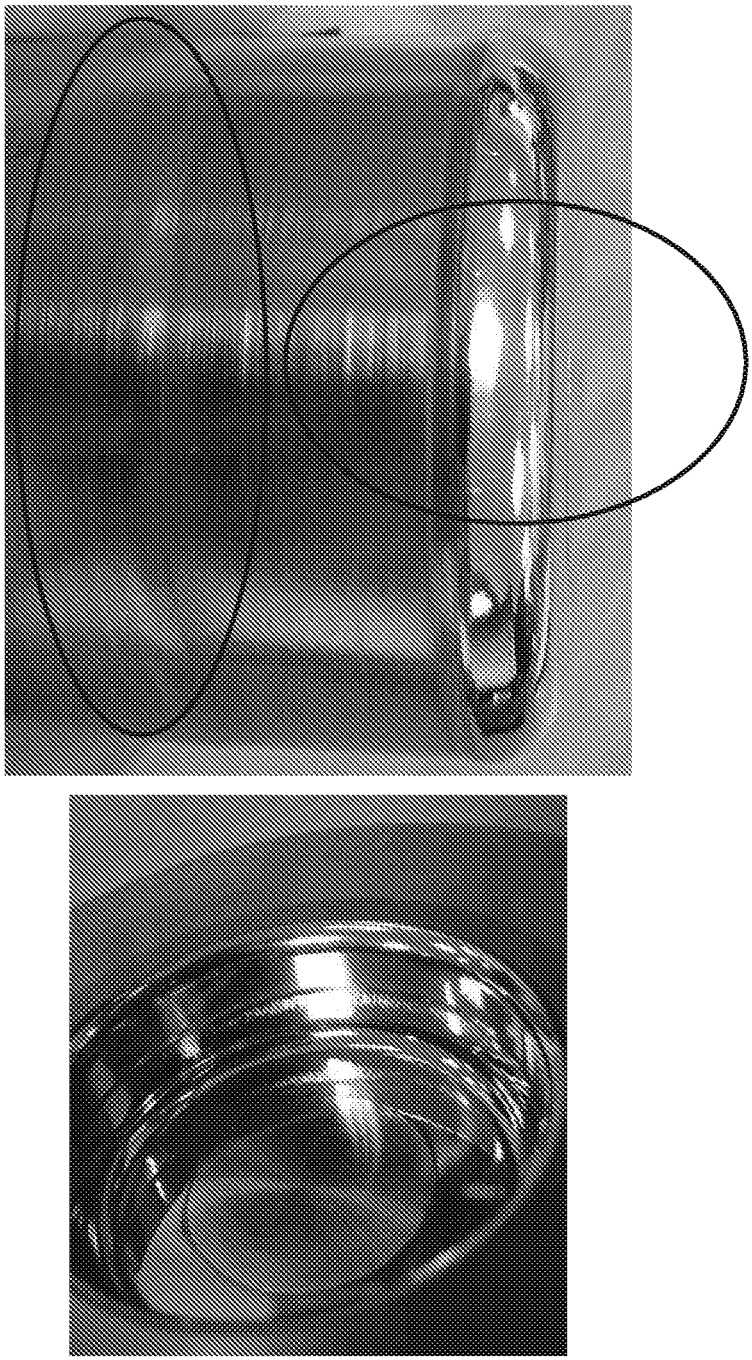
FIG. 5 illustrates a punch head and press die.

Almost no eccentricity in wall thicknesses (<about 0.02 mm) occurred due to the use of a brand new press die and a punch head. Once again, the slugs from Material 1 appear to perform better than Material 2 slugs. Indeed, similar than the results from Experiment 1, almost no scratch was visible neither inside nor outside the containers with Material 1. When Material 2 slugs were used, scratches appeared after 6-7 ku from time to time on the exterior of the container and mainly on the inside of the container. Additionally, the punch head was significantly worn. FIG. 5 illustrates a steel punch head and a sintered carbide press die. The punch head surface after pressing all Material 1 slugs was without any score mark on it. The press die in sintered carbide was greatly damaged throughout the perimeter. Press speed lines for both experiments were at about 175 cpm and both experiments rant without major stops.

Table 24 illustrates the extrusion force for samples made using the parameters discussed in Experiment 1 for Materials 1 and 2 and Experiment 2 for Material 1 and 2. A reference material of 1050 is also shown. The values in the table are approximate.

TABLE 24

| Alloy | 1050 (reference) | Material 1 | Material 2 |
|---|---|---|---|
| Example 1 Extrusion Force (kN) | 1050-1100 | 1090-1150 | 1100-1170 |
| Example 2 Extrusion Force (kN) | — | 1130-1200 | 1150-1300 |

There was no significant increase of extrusion power across the samples, regardless of the material or the starting dimensions of the slugs. The values are far below the safe limit for the final container size.

Table 25 illustrates the tube parameters for Materials 1 and 2 using the slug dimensions of Experiment 1 and the tube parameters for Materials 1 and 2 using the slug dimensions of Experiment 2. The values in the table are approximate.

TABLE 25

| Tube Parameters | Bottom Thickness (mm) | Bottom Wall Thickness (mm) | Top Wall Thickness (mm) | Trimmed Length (mm) |
|---|---|---|---|---|
| Tolerance | 0.70-0.80 | 0.27-0.31 | 0.34-0.38 | min. 2 |
| 1050 (reference) | 0.75 | 0.285 | 0.35 | 4-6 |
| Material 1 Experiment 1 | 0.77 | 0.285 | 0.35 | 5-7 |
| Material 2 Experiment 1 | 0.73 | 0.29 | 0.35 | 4-6 |
| Material 1 Experiment 2 | 0.73 | 0.24 | 0.32 | 10-11 |
| Material 2 Experiment 2 | 0.68 | 0.245 | 0.325 | 9-10 |

As illustrated in Table 25, the bottom thickness was within the tolerance for each material except for Material 2, Experiment 2. The bottom wall thickness tolerance and the top wall thickness tolerance were not achieved for either Experiment 2 material.

Table 26 illustrates the bulging depth (mm) and the porosity in (mA), which is a measure of the integrity of the interior coating. The values in the table are approximate.

TABLE 26

| Alloy | 1050 (reference) | Material 1 | | Material 2 | |
|---|---|---|---|---|---|
| Experiment 1 | 8.2 mm/ 1.6 mA | 8 mm/ 16 mA | 7.6 mm/ 1 mA | 7.5 mm/2 mA | |
| Experiment 2 | — | 7.6 mm/0.8 mA | | 7.6 mm/ 14 mA | 7.3 mm/ 2.3 mA |

Tubes with the dimensions of Experiment 1 and Experiment 2 parameters were necked properly with both Material 1 and Material 2 slugs. New pilots were needed to run lightweight cans, the necking shape and all dimensional parameters remained within specification. The chimney thickness (about 0.45 to about 0.48 mm with white basecoat) before curling was sufficiently thick. Furthermore, the trim length at necking was satisfactory at about 2.4 mm.

Slugs made from both Material 1 and Material 2 created porosity after the bulging at the necking station. After decreasing bulge depth, the porosity level came back to normal. Furthermore, decreasing the bulging depth for a second time with Material 2 helped to resolve porosity issues.

Figure 6:
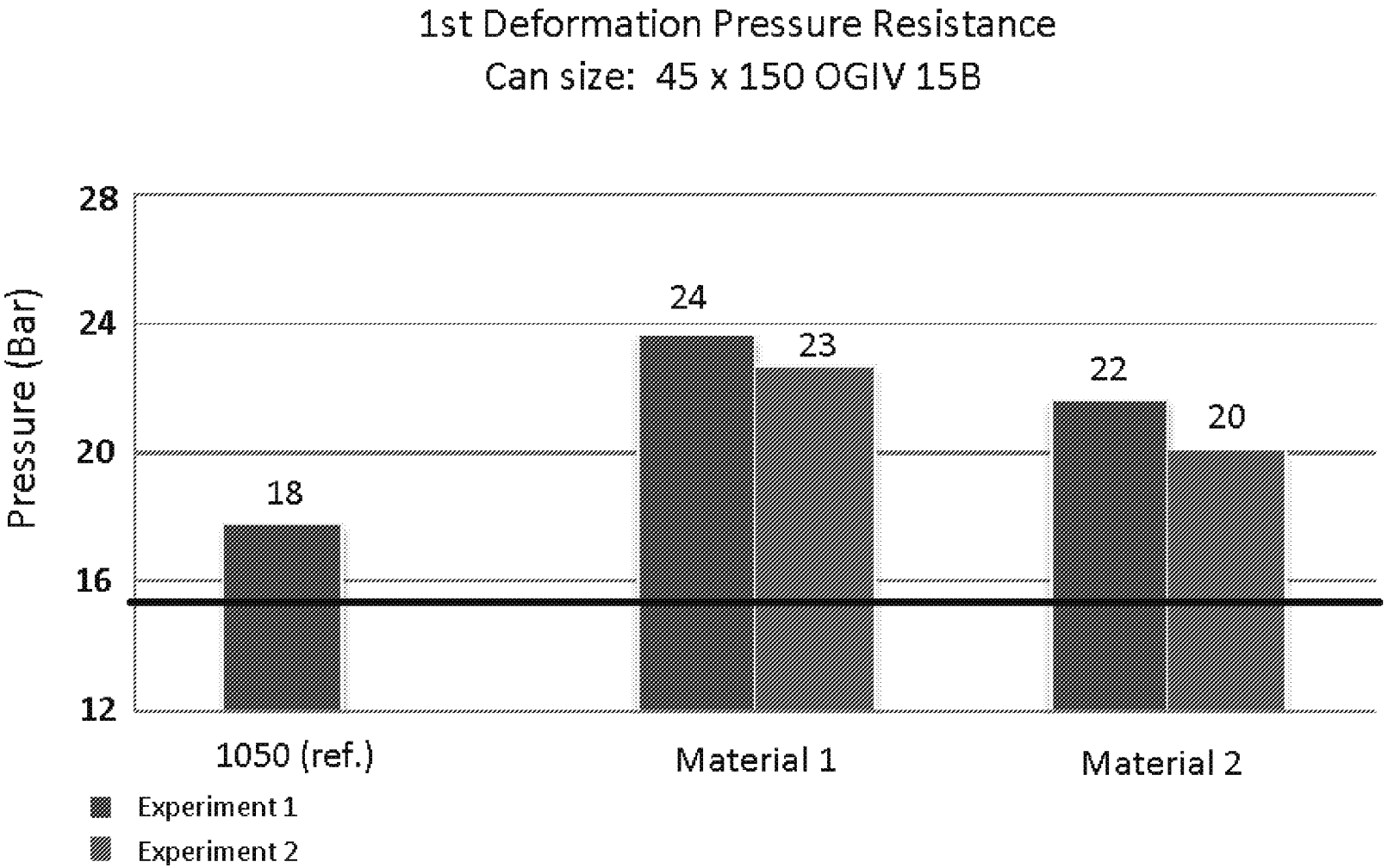
FIG. 6 illustrates deformation pressure resistance for containers made with Material 1 and Material 2.
Figure 7:
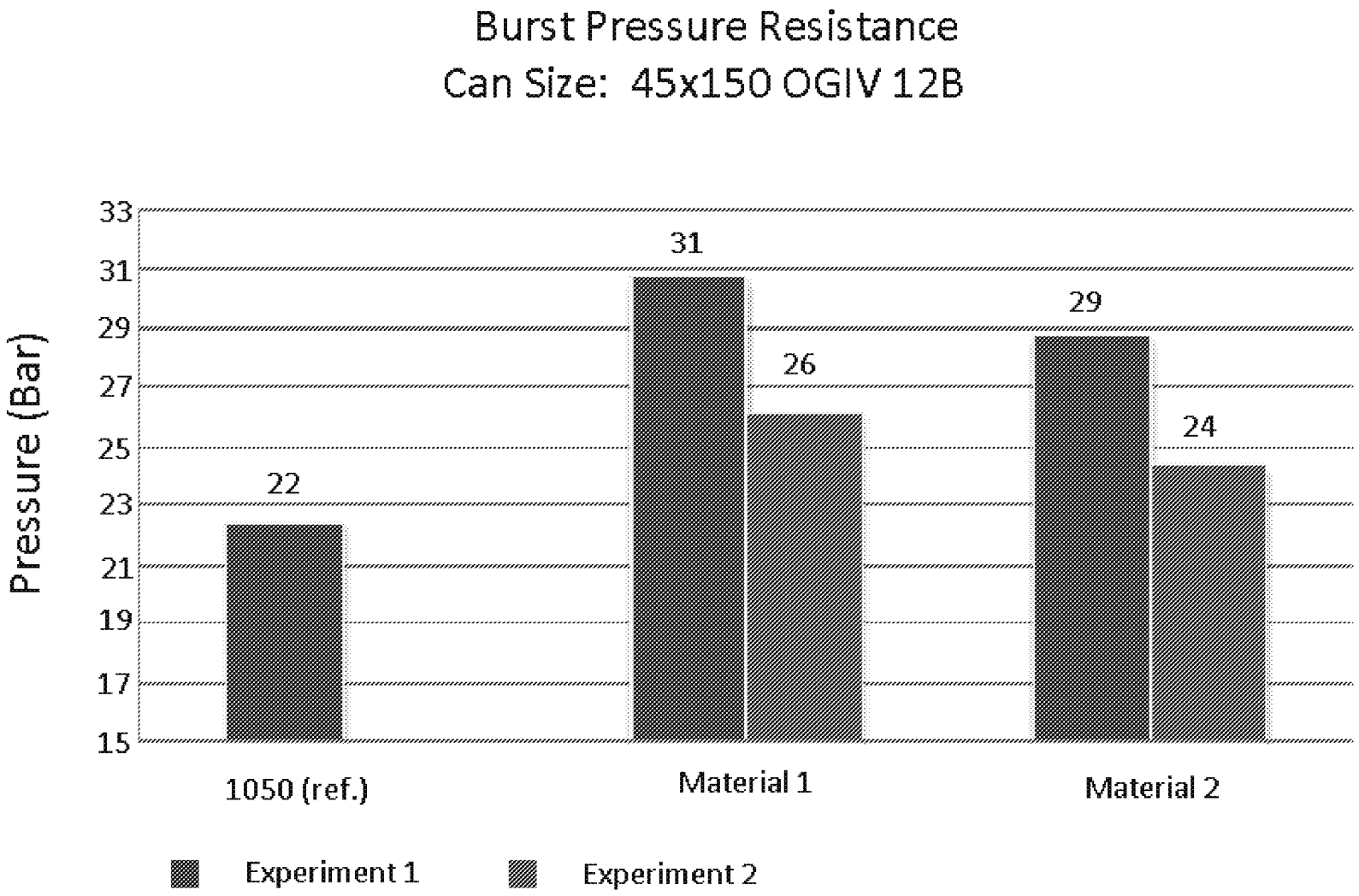
FIG. 7 illustrates burst pressure resistances for Material 1 and Material 2.
Figure 8:
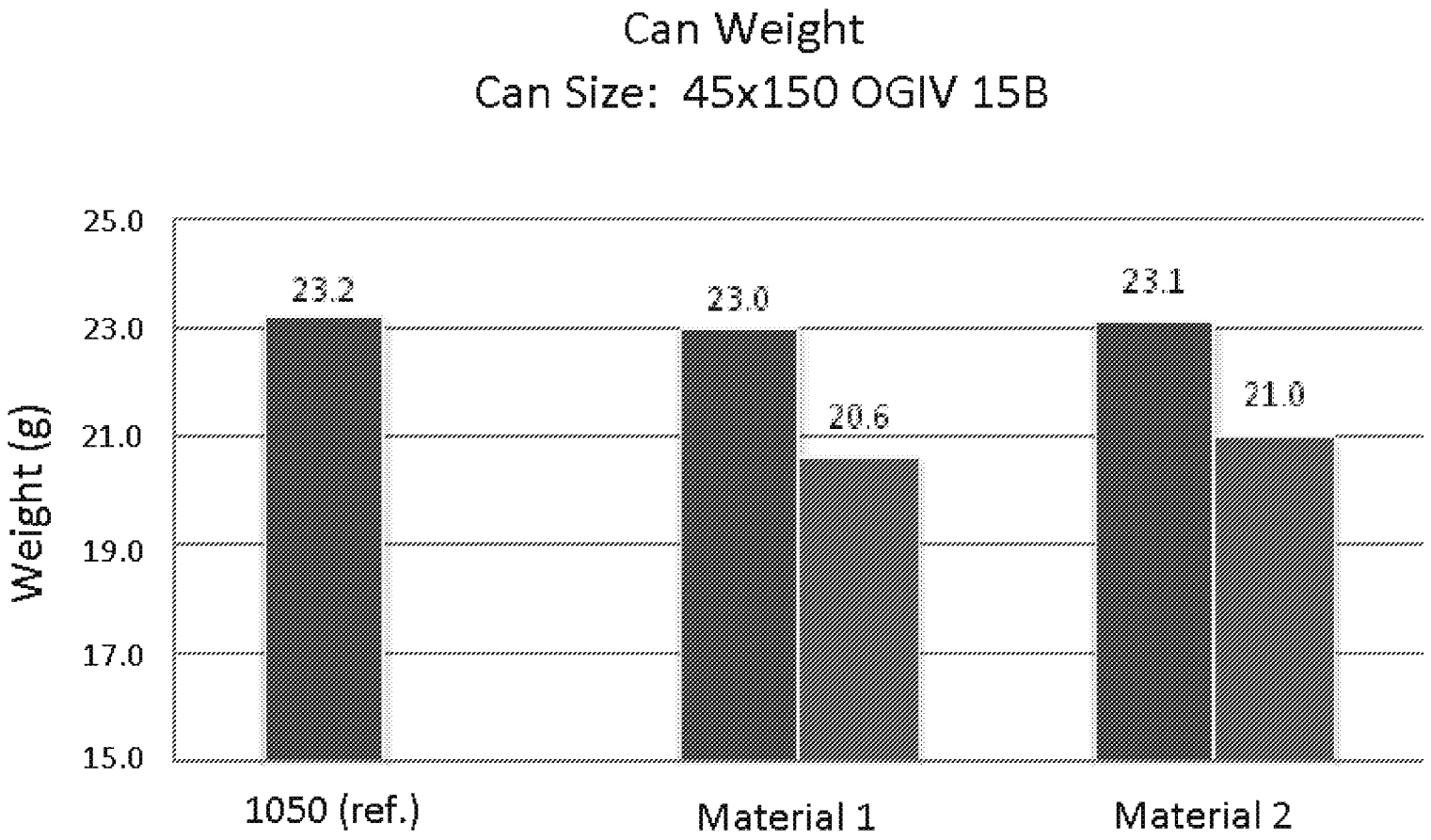
FIG. 8 illustrates container masses for sample Material 1 and sample Material 2.

Regarding pressure resistance, results are very impressive even for the lightweight cans. Surprisingly, Material 1 slugs have higher pressure resistance (about +2 bars) even if they have lower percentage of magnesium and percentage of iron than the Material 2 ones. Though the cause is unclear, it may be a consequence of the continuous annealing performed in Material 1 versus the batch annealing. FIG. 6 illustrates first deformation pressure resistance for cans, while FIG. 7 illustrates the burst pressure for cans. FIG. 8 illustrates the container masses and alloy compositions.

Example 3

Example 3 illustrates the pressure performance of cans with about 0, 20, 40 and 60 wt. % AA 3104 with the balance being AA1070. It also shows pressure results for the 20% alloy with thinner (optimized) walls. The burst pressure can be set forth by regulations for a jurisdiction. By way of example, in the United States, the minimum burst pressure can be set by the Department of Transportation (240 psig). In other jurisdictions, the minimum burst pressure can be about 208 psig.

The slug size for this experiment was about 44.65 mm in diameter and about 5.5 mm in height. The slugs were finished by shot-blasting and were conical in shape. The slugs were extruded, then necked resulting in a can size of about 45 mm in diameter and about 150 mm in height. The cans were necked using a standard necking process. The internal varnish was an epoxy phenolic and the basecoat was a clear semi-matt, followed by gloss over varnish.

Table 27 provides the tube parameters after extrusion. The values in the table are approximate.

TABLE 27

| Tube Parameters | Bottom Thickness (inch) | Bottom Wall Thickness (inch) | Top Wall Thickness (inch) |
|---|---|---|---|
| 1070 | 0.028 | 0.011 | 0.014 |
| Re20 | 0.032 | 0.011 | 0.014 |
| Re20 (optimized parameters) | 0.032 | 0.008 | 0.011 |
| Re40 | 0.028 | 0.011 | 0.013 |
| Re60 | 0.028 | 0.011 | 0.0134 |
| Re60 (optimized parameters) | 0.032 | 0.008 | 0.011 |

Table 6 above provides the pressure measurement in bars after the first deformation and the burst pressure.

As discussed above, FIGS. 9A and 9B illustrate a necked can for a 1070 alloy and a Re60 alloy, respectfully. FIG. 9A necked well, while FIG. 9B were unable to be extruded.

Ranges have been discussed and used within the forgoing description. One skilled in the art would understand that any sub-range within the stated range would be suitable, as would any number within the broad range, without deviating from the invention.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A slug used for a backward impact extrusion process to form a metallic container which is configured to receive an end closure, the slug formed from an aluminum alloy comprising between 40 wt. % and 90 wt. % of a first aluminum and between 10 wt. % and 60 wt. % of a second aluminum, wherein neither the first aluminum nor the second aluminum are recycled, and wherein the composition of the aluminum alloy slug comprises:

at least 97.56 wt. % Al;

between about 0.07 wt. % Si and about 0.18 wt. % Si;

between about 0.22 wt. % Fe and about 0.44 wt. % Fe;

between 0.015 wt. % Cu and about 0.2 wt. % Cu;

between about 0.22 wt. % Mn and about 0.65 wt. % Mn;

between about 0.06 wt. % Mg and about 0.20 wt. % Mg;

between about 0.02 wt. % Ti and about 0.05 wt. % Ti; and a balance comprising at least one of Zn, Cr and impurities; and wherein a thickness of the slug is between 3.81 millimeters (mm) and 14.0 mm, and a diameter or width of the slug is between 20.3 mm and 88.9 mm.

2. The slug of claim 1, wherein the aluminum alloy further comprises:

between 0.03 wt. % Cu and 0.18 wt. % Cu;

at most 0.17 wt. % Mg;

between about 0.02 wt. % Zn and about 0.04 wt. % Zn; and between about 0.02 wt. % Cr and about 0.04 wt. % Cr.

3. The slug of claim 1, further comprising a titanium boride added to a melt of the first aluminum and the second aluminum to alter a grain structure of the aluminum alloy.

4. The slug of claim 1, wherein a hardness of the slug is between 52.4 HB and 68.8 HB.

5. The slug of claim 1, wherein a hardness of the slug is between 50 HB and 66 HB.

6. The slug of claim 1, wherein a yield strength of a sample of the slug with a thickness of 5.5 mm is between 20.7 MPa and 55.2 MPa.

7. The slug of claim 1, wherein a tensile strength of a sample of the slug with a thickness of 5.5 mm is between 96.5 MPa and 144.8 MPa, and wherein an elongation percent of a sample of the slug with a thickness of 5.5 mm is between 30% and 42%.

8. A method to produce a slug formed from an aluminum alloy, the slug configured for use in a backward impact extrusion process to form a metallic container which is configured to receive an end closure, comprising:

combining between 40 wt. % and 90 wt. % of a first aluminum alloy and between 10 wt. % and 60 wt. % of a second aluminum alloy to form the aluminum alloy, wherein neither the first aluminum alloy nor the second aluminum alloy are recycled, and wherein the composition of the aluminum alloy comprises:

at least 97.56 wt. % Al;

between about 0.07 wt. % Si and about 0.18 wt. % Si;

between about 0.22 wt. % Fe and about 0.44 wt. % Fe;

between 0.015 wt. % Cu and about 0.2 wt. % Cu;

between about 0.22 wt. % Mn and about 0.65 wt. % Mn;

between about 0.06 wt. % Mg and about 0.20 wt. % Mg;

between about 0.02 wt. % Ti and about 0.05 wt. % Ti; and a balance comprising at least one of Zn, Cr and impurities; and forming the slug from the aluminum alloy, wherein a thickness of the slug is between 3.81 millimeters (mm) and 14.0 mm, and a diameter or width of the slug is between 20.3 mm and 88.9 mm.

9. The method of claim 8, further comprising:

melting the first aluminum alloy and the second aluminum alloy to form a melt; and adding titanium boride to the melt to alter a grain structure of the aluminum alloy, wherein the first aluminum alloy is selected from a first group consisting of AA1059, AA1070 or P1020A, and wherein the second aluminum alloy is selected from a second group consisting of AA3104, AA3004, AA3105, AA3003 or AA3103.

10. A method for producing a metallic container which is configured to receive an end closure in a backward impact extrusion process from a slug formed from an aluminum alloy, comprising:

providing the slug formed of the aluminum alloy, wherein the aluminum alloy is formed by combining between 40 wt. % and 90 wt. % of a first aluminum alloy and between 10 wt. % and 60 wt. % of a second aluminum alloy, wherein neither the first aluminum alloy nor the second aluminum alloy are recycled, and wherein the composition of the aluminum alloy comprises:

at least 97.56 wt. % Al;

between about 0.07 wt. % Si and about 0.18 wt. % Si;

between about 0.22 wt. % Fe and about 0.44 wt. % Fe;

between 0.015 wt. % Cu and about 0.2 wt. % Cu;

between about 0.22 wt. % Mn and about 0.65 wt. % Mn;

between about 0.06 wt. % Mg and about 0.20 wt. % Mg;

between about 0.02 wt. % Ti and about 0.05 wt. % Ti; and a balance comprising at least one of Zn, Cr and impurities; and wherein a thickness of the slug is between 3.81 millimeters (mm) and 14.0 mm, and a diameter or width of the slug is between 20.3 mm and 88.9 mm.

11. The slug of claim 1, wherein the aluminum alloy comprises between about 0.02 wt. % Zn and about 0.04 wt. % Zn.

12. The slug of claim 11, wherein the aluminum alloy comprises between about 0.02 wt. % Cr and about 0.04 wt. % Cr.

13. The slug of claim 12, wherein the aluminum alloy comprises at least about 0.03 wt. % Cu.

14. The slug of claim 1, wherein the aluminum alloy comprises at least about 0.03 wt. % Cu.

15. The slug of claim 1, wherein the slug includes recesses on at least one surface to hold a lubricant.

16. The slug of claim 15, wherein the slug is coated with a lubricant.

17. The slug of claim 1, wherein the first aluminum is selected from a first group consisting of AA1050, AA1070 or P1020A.

18. The slug of claim 17, wherein the second aluminum is selected from a second group consisting of AA3104, AA3004, AA3105, AA3003 or AA3103.

19. The slug of claim 1, wherein the slug has a mass of between about 21.1 g and about 23.3 g.

* * * * *